US009915051B2

(12) United States Patent
Niroumand

(10) Patent No.: US 9,915,051 B2
(45) Date of Patent: Mar. 13, 2018

(54) MANDREL FOR FORMING AN AGGREGATE PIER, AND AGGREGATE PIER COMPACTING SYSTEM AND METHOD

(71) Applicant: Bahman Niroumand, Boushehr Port (IR)

(72) Inventor: Bahman Niroumand, Boushehr Port (IR)

( * ) Notice: Subject to any disclaimer, the term of this patent is extended or adjusted under 35 U.S.C. 154(b) by 0 days.

(21) Appl. No.: 15/234,835

(22) Filed: Aug. 11, 2016

(65) Prior Publication Data

US 2017/0058477 A1 Mar. 2, 2017

(30) Foreign Application Priority Data

Sep. 1, 2015 (IR) ..... 13945014000300625

(51) Int. Cl.

| | |
|---|---|
| ***E02D 3/08*** | (2006.01) |
| ***E02D 5/62*** | (2006.01) |
| ***E02D 27/14*** | (2006.01) |
| ***E02D 27/18*** | (2006.01) |
| ***E02D 27/26*** | (2006.01) |
| ***E02D 5/60*** | (2006.01) |

(52) U.S. Cl.

CPC ..... *E02D 3/08* (2013.01); *E02D 5/60* (2013.01); *E02D 5/62* (2013.01); *E02D 27/14* (2013.01); *E02D 27/18* (2013.01); *E02D 27/26* (2013.01)

(58) Field of Classification Search

CPC ..... E02D 3/08; E02D 27/18; E02D 27/26; E02D 5/62; E02D 27/14; E02D 5/66; E02D 7/28; E02D 3/046

USPC .... 405/231, 232, 245, 249, 253; 175/22, 23, 175/171, 257, 293, 294, 295, 423; 166/285, 286

See application file for complete search history.

(56) References Cited

U.S. PATENT DOCUMENTS

| | | | | |
|---|---|---|---|---|
| 5,449,253 | A * | 9/1995 | Roger | E02D 7/28 405/232 |
| 6,306,296 | B1 | 10/2001 | Kerfoot | |
| 6,402,432 | B1 | 6/2002 | England et al. | |
| 7,326,004 | B2 | 2/2008 | Wissmann et al. | |
| 7,901,159 | B2 | 3/2011 | Fox | |
| 8,152,415 | B2 | 4/2012 | Fox et al. | |
| 8,740,501 | B2 | 6/2014 | Maher et al. | |
| 2004/0028480 | A1 * | 2/2004 | Verstraeten | E02D 5/32 405/233 |

(Continued)

*Primary Examiner* — Carib A Oquendo

(57) ABSTRACT

An aggregate pier compacting system for forming a compacted aggregate pier (AP) at a target location includes a mandrel, a tamper device, and a finishing tamper device. The mandrel includes a casing for housing a drilling shaft (DS). An external vibratory hammer (EVH) repeatedly impacts a hammer element (HE) extending from the DS. The DS transfers the impact to a bore head to form a cavity at the target location. The DS is removed and the casing is filled with aggregate. The tamper device includes a compacting shaft. The EVH impacts a second HE extending from the compacting shaft and transfers the impact to a compaction head to form the compacted AP. The finishing tamper device includes a shaft. The EVH impacts a third HE extending from the shaft and transfers the impact to a finishing head compacting a top layer of the AP to form a finished AP.

17 Claims, 20 Drawing Sheets

(56) References Cited

U.S. PATENT DOCUMENTS

| | | | | |
|---|---|---|---|---|
| 2004/0099300 | A1* | 5/2004 | Warren | E04H 15/62 135/118 |
| 2004/0129855 | A1* | 7/2004 | Chen | E04H 17/263 248/545 |
| 2006/0147274 | A1* | 7/2006 | Ding | E02D 5/44 405/237 |
| 2007/0077128 | A1* | 4/2007 | Wissmann | E02D 3/046 405/232 |
| 2008/0193223 | A1* | 8/2008 | Wissmann | E02D 3/08 405/229 |
| 2009/0290940 | A1* | 11/2009 | Martin, Sr. | E02D 3/123 405/232 |
| 2010/0028087 | A1* | 2/2010 | Wissmann | E02D 3/08 405/240 |
| 2011/0243666 | A1* | 10/2011 | Fox | E02D 3/08 405/232 |
| 2013/0051927 | A1* | 2/2013 | Kruse | E02D 13/10 405/233 |
| 2013/0177359 | A1 | 7/2013 | Hamata et al. | |
| 2013/0195560 | A1* | 8/2013 | Siepi | E02D 27/12 405/232 |
| 2015/0330051 | A1* | 11/2015 | White | E02D 27/18 405/249 |

* cited by examiner

MANDREL FOR FORMING AN AGGREGATE PIER, AND AGGREGATE PIER COMPACTING SYSTEM AND METHOD

BACKGROUND OF THE INVENTION

Recently, with the growth of urban and industrial areas, and the shortage of land and high quality materials, demand for use of marginal lands is increasing. Additionally, techniques and equipment for improvement of loose and soft soil have been proposed. Generally, soft cohesive soils have two main characteristics, the first one is the low shear strength, and the second one is large settlement. Furthermore, loose granular soils have the great potential of liquefaction.

In the last few decades, compaction using sandy or gravelly columns, pile, piers, etc., has been conducted all over the world as a technical and an economical method. In practice, various methods of compacting gravelly piers were founded on one of the construction replacement, construction displacement, or combination methods. However, the final products, construction process, the configuration, and the effect on the relative density of gravel and matrix soil, which were constructed by each of the aforementioned methods, are very different. Generally, the gravel piers constructed by construction methods which are based on the type of loading, mechanical and physical characteristics of soil layers, and environmental conditions, are divided into multiple categories, for example, stone columns, compaction piles, rammed aggregate piers, etc.

Typically, stone columns are constructed by replacement of loose material with gravelly material by two methods of vibrating replacement and vibrating compaction. Compaction piles are constructed based on displacement mechanism by means of excavating a hole in the ground and making a radial compaction for the surrounding soil and filling it by sandy or gravelly material by two methods of sand compaction piles and gravel compaction piles. Rammed aggregate piers are made of methods based on the combination of replacement and displacement, and by means of excavating a hole by mechanical auger, filling it by gravelly material and making a radial compaction in the layers.

Generally, aggregate piers with 0.6-1.5 inch diameter and 2-10 meters length are compacted in a square or triangular pattern in a weak soil base. Aggregate piers with depths of more than 10 meters are not as economical as deep concrete foundations. However, there are many reports signifying the construction of aggregate piers with 10-30 meters length. Compaction piers compact the soil by two mechanisms, for example, volume displacement of the soil equal to the volume of the pier, and the soil compaction around the pier due to vibrations caused by driving the pier.

Conventional construction methods of aggregate piers that are used in most companies include vibro-replacement method, Fanki method of rammed aggregate piers, Fox and Lowton method of rammed aggregate piers, etc. In the vibro-replacement wet method, a hole is formed in the ground by jetting a probe down to the desired depth. The uncased hole is flushed out and then stone is added in 0.3-1.2 m increments and made dense by means of an electrically or hydraulically actuated vibrator located near the bottom of the probe. The wet process is generally used where borehole stability is questionable. Therefore, it is suited for sites underlain by very soft to firm soils and a high ground water table.

The wet process produces a great deal of environmental pollution especially in limited area of urban lands due to exit slurry from the wells and the need for surrounding areas for construction of sediment basins. Furthermore, the wet process cannot be applied to loose soils and soils with low bearing strength. In such soils, the probability of destruction of buildings surrounding the excavated area is higher. In areas having water shortages, it is disadvantageous to use water that is mandatory for the wet process.

Therefore, a method of construction of aggregate piers, which is environment friendly, applicable to loose soils, and applicable in regions having water shortages, is required. Moreover, heavy machinery and equipment are needed for the vibro-replacement wet method. The great height and volume of heavy machinery and inability of applying them in urban areas due to space constraints renders the process disadvantageous. An aggregate compacting system, which occupies minimum space and is easy to handle, is required.

In the vibro displacement dry method, the jetting water during initial formation of the hole is absent. For using the vibro-displacement dry method, the vibrated hole must be able to stand open upon extraction of the probe. Therefore, for vibro-displacement to be possible, soils must exhibit shear strengths in excess of about 40-60 kPa, with a relatively low ground water table being present at the site. Stabilization is made possible by using a "bottom feed" type vibrator. Eccentric tubes adjacent to the probe allow delivery of stone, sand or concrete to the bottom of the excavated hole without extracting the vibrator. Using this method, the vibrator serves as a casing, which prevents collapse of the hole. This method cannot be used in areas having a high water table. A system and method of compacting aggregate piers, which are deployable in regions having high water table, is required.

In the Fanki method, rammed aggregate piers are constructed by either driving an open or closed end pipe in the ground or boring a hole. A mixture of sand and stone is placed in the hole in increments. The mixture is rammed in using a heavy, falling weight. Disturbance and subsequent remolding of sensitive soils by the ramming operation, however, may limit its utility in these soils. Additional infrastructure is required when using heavy machinery devices in unstable loose soils. The great height and volume of instruments and machinery devices render them unusable in urban areas due to constraints of passages. Inability to apply them in urban areas due to high vibrations because of compaction strikes and the probability of great destructions is another disadvantage. In limited urban areas, which urge rehabilitation of layers with little thickness, the mentioned method has concerns and is not economical.

The Fox and Lowton method of rammed aggregate piers (RAPs) are one of the soft soils reinforcement techniques used to reduce intolerable settlements. Additionally, the method serves to improve the bearing capacity and stiffness in various building projects. The construction process of rammed aggregate piers consists of cavity drilling, making end-resistant bulbs, and implementing pier shafts. End-resistant bulbs and pier shafts are constructed using layers of open graded and well-graded gravel, respectively. The nominal thickness of aggregate layers is about 0.3 m and each layer is compacted using a specially designed, beveled tamper connected to a hydraulic hammer. The hydraulic hammer delivers between 1-2 million ft-lbs of energy to the RAP at approximately 400 blows per minute. Because of aggregate compaction, the soft soil at the end bulb is to deform downward and laterally, and in the next aggregate layers, the soft soil around the pier deform laterally under compression. In this method, excavation of the well by mechanical auger for each pier is mandatory. Moreover, the wells excavated in loose and collapsible soils with high water level are highly unstable. The casing pipe must be applied individually for each pier followed by removing the soil. This affects the speed of the method and results in delays in project execution. Additionally, this method suffers from lack of technical and economic feasibility in some cases. Thus, a method which is applicable in loose soils with high water level, allows quick implementation, and is technically and economically feasible, is required.

Hence, there is a long felt but unresolved need for a method of construction of aggregate piers, which is environment friendly, applicable to loose soils, and applicable in regions having water shortages. Furthermore, there is a need for an aggregate compacting system, which occupies minimum space and is easy to handle. Moreover, there is a need for a system and method of compacting aggregate piers, which are deployable in regions having high water table. Furthermore, there is a need for a method, which is applicable in loose soils with high water level, allows quick implementation, and is technically and economically feasible.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The invention disclosed herein addresses the above-mentioned need for a method of construction of aggregate piers, which is environment friendly, applicable to loose soils, and applicable in regions having water shortages. Furthermore, the invention disclosed herein addresses the need for an aggregate compacting system, which occupies minimum space and is easy to handle. Moreover, the invention disclosed herein addresses the need for a system and method of compacting aggregate piers, which are deployable in regions having high water table. Furthermore, the invention addresses the need for a method, which is applicable in loose soils with high water level, allows quick implementation, and is technically and economically feasible. The aggregate pier compacting system for forming a compacted aggregate pier at a target location disclosed herein comprises a mandrel, a tamper device, and a finishing tamper device. The mandrel for forming an aggregate pier at the target location comprises a casing and a drilling shaft. The casing having a generally hollow cylindrical configuration houses the drilling shaft. The drilling shaft comprises a first end and a second end. A generally cuboidal hammer element extends from the first end of the drilling shaft for receiving multiple impact from an external vibratory hammer.

The first end is detachably attached to the casing via a locking pin for transferring the impact to a bore head positioned at the second end of the drilling shaft for forming a cavity at the target location. The drilling shaft is detached from the casing to fill the casing with aggregate. The aggregate filled casing forms the aggregate pier at the target location. The tamper device for compaction the filled aggregate comprises a compacting shaft comprising a first end and a second end. A generally cuboidal second hammer element extends from the first end of the compacting shaft for receiving multiple impacts from the external vibratory hammer and transfers the impact to a compaction head positioned at the second end of the compacting shaft for forming the compacted aggregated pier at the target location. The finishing tamper device comprises a shaft. The shaft comprises a first end and a second end. A generally cuboidal third hammer element extends from the first end of the shaft for receiving multiple impacts from the external vibratory hammer and transferring the impact to a finishing head positioned at the second end of the shaft for compaction a top layer of the compacted aggregate pier to form a finished aggregate pier.

The disclosed invention uses light and compact machinery devices to take into consideration space constraints in urban areas, narrow width of passages, etc. Further the system and method disclosed herein does not require water, is implemented in loose soils, liquefiable soil layers and coastal layers. Furthermore, the method does not require excavation of loose layers. Moreover, the method is implemented with minimal time requirements. Additionally, the method disclosed herein is economically and technically feasible. Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

One aspect of the present disclosure is a mandrel for forming an aggregate pier at a target location, the mandrel comprising: a casing having a generally hollow cylindrical configuration for housing a drilling shaft; and the drilling shaft comprising a first end and a second end, a generally cuboidal hammer element extending from the first end of the drilling shaft for receiving multiple impacts from an external vibratory hammer, the first end detachably attached to the casing via a locking system for transferring the impact to a bore head positioned at the second end of the drilling shaft for forming a cavity at the target location, wherein the drilling shaft is detached from the casing to fill the casing with aggregate, and wherein the aggregate filled casing forms the aggregate pier at the target location.

In one embodiment, the aggregate pier is compacted by a tamper device comprising a compacting shaft, the compacting shaft comprising a first end and a second end, a generally cuboidal second hammer element extending from the first end of the compacting shaft for receiving multiple impacts from the external vibratory hammer and transferring the impact to a compaction head positioned at the second end of the compacting shaft for forming the compacted aggregated pier at the target location.

In another embodiment, a top layer of the compacted aggregate pier is finely compacted by a finishing tamper device comprising a shaft, the shaft comprising a first end and a second end, a generally cuboidal third hammer element extending from the first end of the shaft for receiving multiple impact from the external vibratory hammer and transferring the impact to a finishing head positioned at the second end of the shaft for compacting the top layer of the compacted aggregate pier to form a finished aggregate pier at the target location.

In one embodiment of the mandrel, the aggregate is a gravel material. In one embodiment, the bore head is of one of a conical configuration and a pyramidal configuration. In one embodiment, the bore head is configured in a wedge shape to bore through hard rock surfaces. In one embodiment, the target location is selected from a group consisting of a loose sandy soil, a clayey soil, a medium density soil, and a hard rock soil bed.

One aspect of the present disclosure is directed to an aggregate pier compacting system for forming a compacted aggregate pier at a target location. This aggregate pier compacting system comprises (a) a mandrel for forming an aggregate pier at the target location comprising: a casing having a generally hollow cylindrical configuration for housing a drilling shaft; and the drilling shaft comprising a first end and a second end, a generally cuboidal hammer element extending from the first end of the drilling shaft for receiving multiple impacts from an external vibratory hammer, the first end detachably attached to the casing via a locking system for transferring the impact to a bore head positioned at the second end of the drilling shaft for forming a cavity at the target location, wherein the drilling shaft is detached from the casing to fill the casing with aggregate, and wherein the aggregate filled casing forms the aggregate pier at the target location; (b) a tamper device for compacting the filled aggregate comprising a compacting shaft comprising a first end and a second end, a generally cuboidal second hammer element extending from the first end of the compacting shaft for receiving multiple impact from the external vibratory hammer and transferring the impact to a compaction head positioned at the second end of the compacting shaft for forming the compacted aggregated pier at the target location; and (c) a finishing tamper device comprising a shaft, the shaft comprising a first end and a second end, a generally cuboidal third hammer element extending from the first end of the shaft for receiving multiple impact from the external vibratory hammer and transferring the impact to a finishing head positioned at the second end of the shaft for compacting a top layer of the compacted aggregate pier to form a finished aggregate pier at the target location.

In one embodiment, the bore head is of one of a conical configuration and a pyramidal configuration. In one embodiment, the bore head is configured in a wedge shape to bore through hard rock surfaces. In another embodiment, the compaction head is of one of a conical configuration and a pyramidal configuration. In one embodiment, the finishing head is of one of a flat bevel configuration and a cylindrical double bevel configuration. In one embodiment, the target location is selected from a group consisting of a loose sandy soil, a clayey soil, a medium density soil, and a hard rock soil bed.

One aspect of the present disclosure is directed to a method for forming a compacted aggregate pier at a target location, the method comprising: (a) providing an aggregate pier compacting system comprising: a mandrel comprising: a casing having a generally hollow cylindrical configuration; and a drilling shaft comprising a first end and a second end, a generally cuboidal hammer element extending from the first end of the drilling shaft, wherein the first end is detachably attached to the casing via a locking system, and wherein a bore head is positioned at the second end of the drilling shaft; a tamper device comprising a compacting shaft comprising a first end and a second end, a generally cuboidal second hammer element extending from the first end of the compacting shaft, wherein a compaction head is positioned at the second end of the compacting shaft; and a finishing tamper device comprising a shaft, the shaft comprising a first end and a second end, a generally cuboidal third hammer element extending from the first end of the shaft, wherein a finishing head is positioned at the second end of the shaft; (b) positioning the mandrel above the target location; (c) generating a cavity by driving the mandrel using an external vibratory hammer; (d) removing the drilling shaft from the casing of the mandrel positioned in the cavity; (e) filling the casing of the mandrel with aggregate at least once; (f) removing the casing from the cavity filled with aggregate; (g) compacting the aggregate filled cavity at least once using the tamper device; and (h) compacting a top layer of the compacted aggregate pier with the finishing tamper device to form a finished aggregate pier at the target location.

In one embodiment, the aggregate is a gravel material. In one embodiment, the bore head is of one of a conical configuration and a pyramidal configuration. In one embodiment, the bore head is configured in a wedge shape to bore through hard rock surfaces. In another embodiment, the compaction head is of one of a conical configuration and a pyramidal configuration. In one embodiment, the finishing head is of one of a flat bevel configuration and a cylindrical double bevel configuration. In one embodiment, the target location is selected from a group consisting of a loose sandy soil, a clayey soil, a medium density soil, and a hard rock soil bed.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF EMBODIMENTS

The present invention generally relates to ground improvement. More particularly, the invention disclosed herein relates to methods and an aggregate pier compaction system for ground improvement by forming compact aggregate piers using aggregates, for example, gravel.

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Figures 1A, 1B:
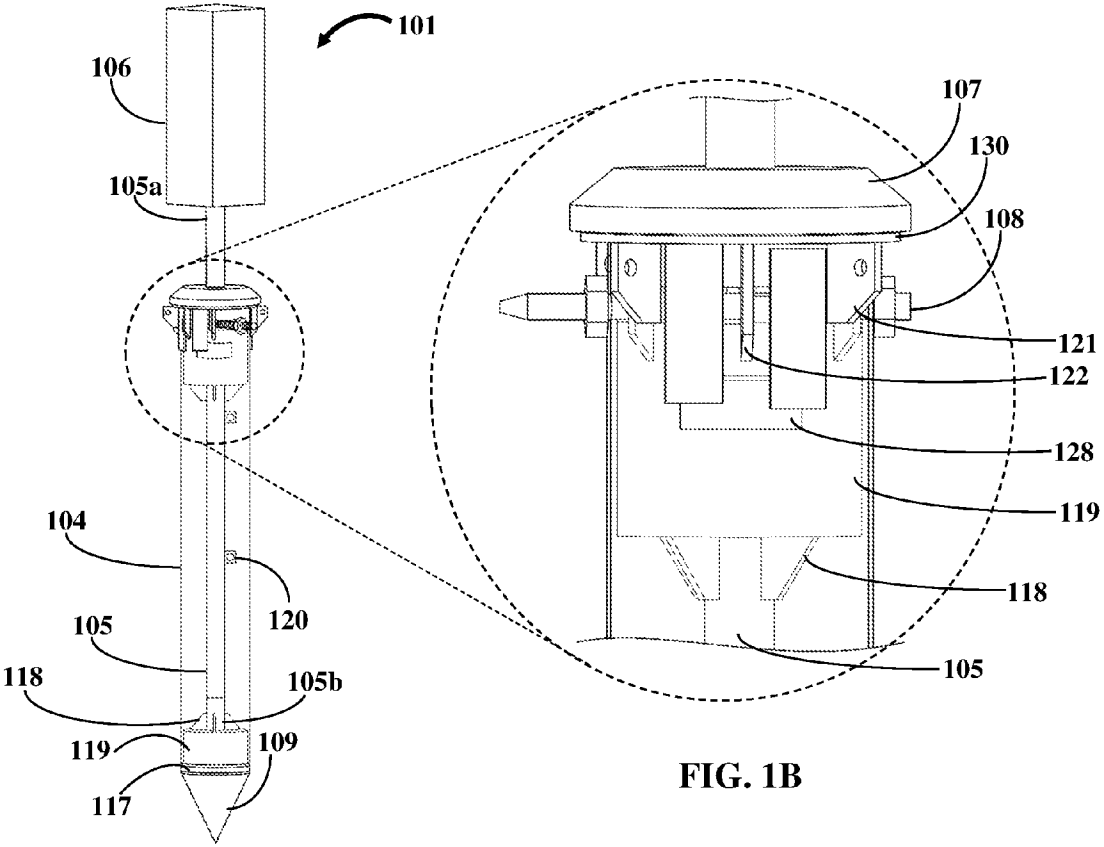
FIG. 1A exemplarily illustrates a perspective view of a mandrel.
FIG. 1B exemplarily illustrates an enlarged view of a section of a mandrel.

FIGS. 1A-1B exemplarily illustrates perspective views of different embodiments of a mandrel 101. The mandrel 101 for forming an aggregate pier 102 at a target location 103 comprises a casing 104, a drilling shaft 105. The casing 104 has a generally hollow cylindrical configuration for housing the drilling shaft 105. The drilling shaft 105 comprises a first end 105*a* and a second end 105*b*. A generally cuboidal hammer element 106 extends from the first end 105*a* of the drilling shaft 105 for receiving multiple impacts from an external vibratory hammer 107. The first end 105*a* of the drilling shaft 105 is detachably attached to the casing 104 via a locking pin 108 for transferring the impact to a bore head 109. The bore head 109 is positioned at the second end 105*b* of the drilling shaft 105 to generate a cavity 110 at the target location 103 as exemplarily illustrated in FIGS. 4-7B. The drilling shaft 105 is detached from the casing 104 by unlocking the locking pin 108. The empty casing 104 is then filled with aggregate. The aggregate filled casing 104 forms the aggregate pier 102 at the target location 103.

A wedge steel ring 117 is provided at the tip of the casing 104 for increasing stiffness of the tip of the casing 104. In an embodiment, four steel stiffener plates 118 are provided to connect the drilling shaft 105 and the steel cylinder 119 attached to the bore head 109. In an embodiment, two connection elements 120 are provided on the drilling shaft 105 for transferring the drilling shaft 105. Similarly, four steel plates 118 are provided at the top of the casing 104 for connection of a steel cylinder 119 to the drilling shaft 105. The steel cylinder 119 is positioned at the top of the drilling shaft 105 for transferring a dynamic force between the casing 104 and the drilling shaft 105. A Steel ring 129 and steel plates 128 are welded on the steel cylinder 119 and the casing 104 for transferring dynamic force between the casing 104 and the drilling shaft 105. The drilling shaft 105 is prevented from rotating inside the casing 104 during hammering by fastening the locking pin 108. Vertical stiffener plates 122 are provided at the top of the casing 104 and a horizontal steel ring 130 for increasing stiffness of the casing 104 and creating a constraint between the vertical stiffener plates 122 and the casing 104 at the top of the casing 104.

In an embodiment, the bore head 109 is of different configurations, for example, a conical configuration, a pyramidal configuration, etc. The different configurations or shapes of the bore head 109 are used based on the requirements of the application. For example, in loose soils, a conical configuration is used and for medium density soils, a pyramidal configuration is used to generate the cavity 110 in the soil. In another embodiment, the bore head 109 is configured in a wedge shape to bore through hard rock surfaces as exemplarily illustrated in FIGS. 1E and 13. In an embodiment, the target location 102 is, for example, a loose sandy soil, a clayey soil, a medium density soil, a hard rock soil bed, etc.

Figures 1C, 1D:
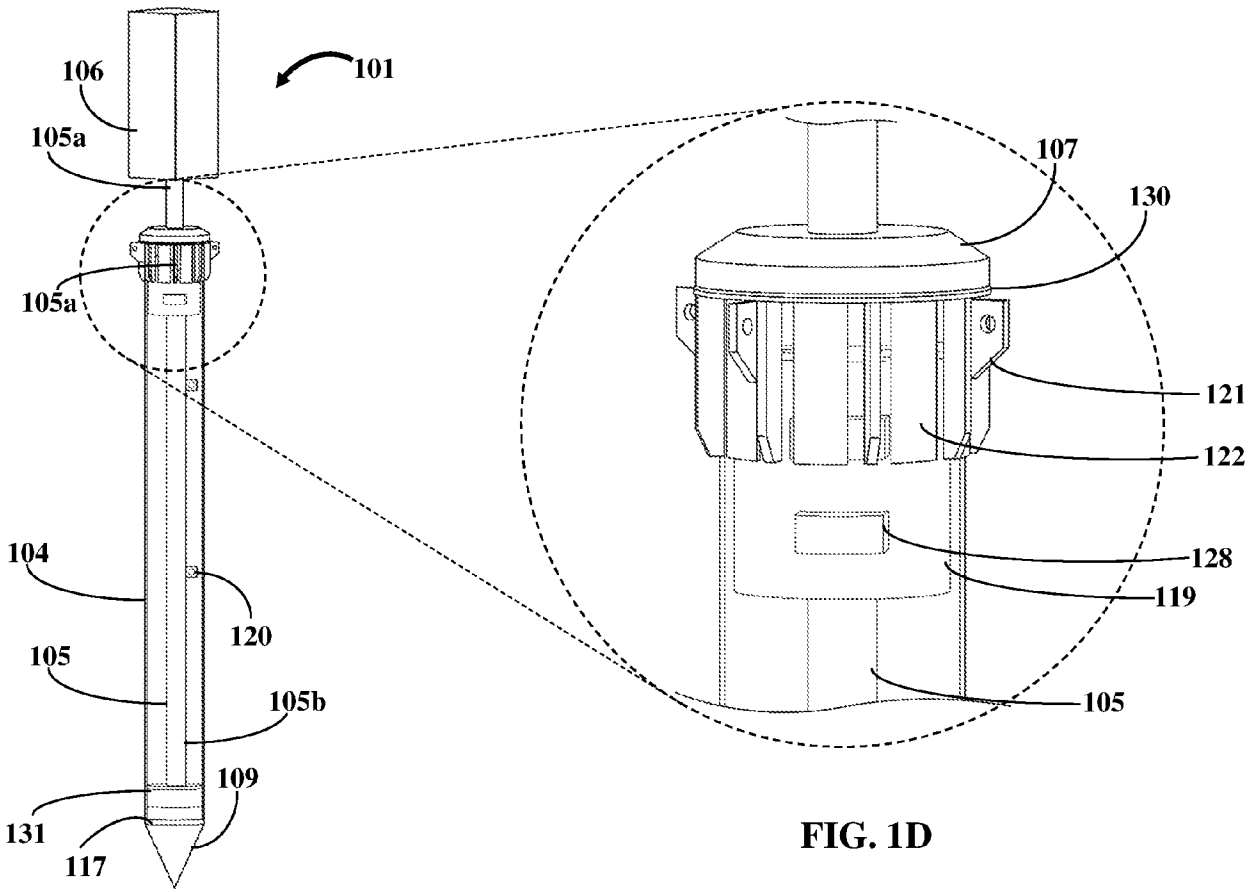
FIG. 1C exemplarily illustrates a perspective view of an embodiment of a mandrel.
FIG. 1D exemplarily illustrates an enlarged view of a section of an embodiment of a mandrel.

FIGS. 1C-1D exemplarily illustrates a perspective view of an embodiment of a mandrel 101. In the embodiment, the mandrel 101 comprises a casing 104 and a drilling shaft 105. The drilling shaft 105 is configured in a shape of a pyramid as exemplarily illustrated in FIGS. 1C-1D. The drilling shaft 105 comprises a first end 105*a* and a second end 105*b*. A generally cuboidal hammer element 106 extends from the first end 125*a* of the drilling shaft 105 for receiving multiple impacts from an external vibratory hammer 107. The first end 105*a* of the drilling shaft 105 is detachably attached to the casing 104 for transferring the impact to a bore head 109. The bore head 109 is positioned at the second end 105*b* of the drilling shaft 105 to generate a cavity 110 at the target location 103 as exemplarily illustrated in FIGS. 4-7B.

The Steel pyramid shaped bore head 109 is positioned at the second end 105*b* of the drilling shaft 105. A wedge steel ring 117 is positioned at the tip of the casing 104. A steel cylinder 119 is provided for increasing the length of bore head 109 and reducing permission of fine sands during drive of the mandrel 101. Multiple connection elements 120 are provided on the drilling shaft 105 for transferring the drilling shaft 105. A steel ring 129 and plates 128 are welded on a steel cylinder 119 positioned on the top of the casing 104 for transfer of dynamic force between the casing 104 and drilling shaft 105. Vertical stiffener plates 122 are positioned at the top of the casing 104. Steel plates 128 are welded on the drilling shaft 105 for connecting the drilling shaft 105 to the casing 104. Horizontal steel rings 117 and 130 are provided at the top and bottom of the casing 104 for increasing stiffness edge of the casing 104 and creating a constraint between the vertical stiffener plates 122 and the casing 104. In an embodiment, a steel cylinder 131 is provided for increasing the length of pyramid part and reduces the permission of fine sands during drive of the mandrel 101.

Figure 1F:
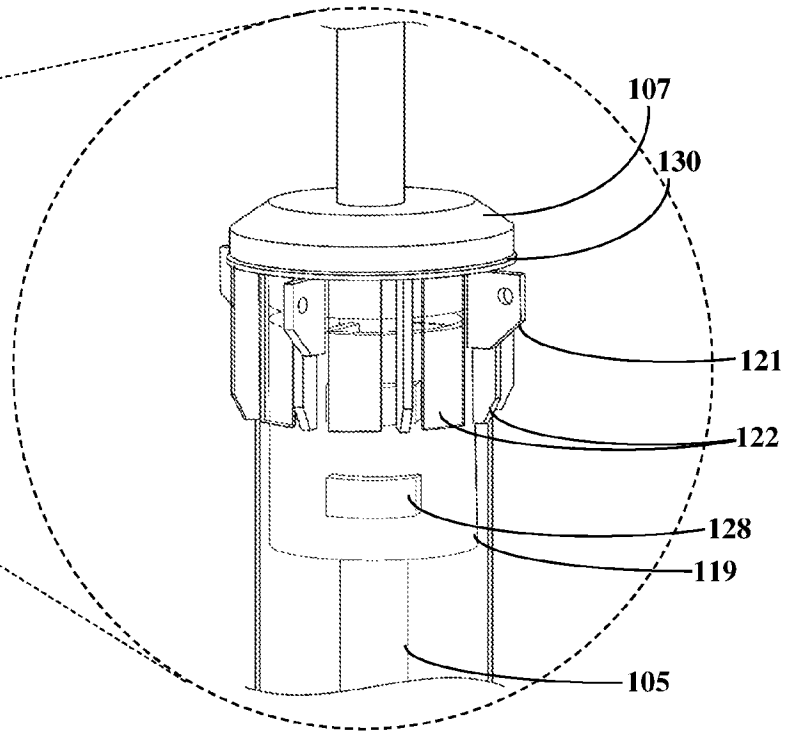
FIG. 1F exemplarily illustrates an enlarged view of a section of an embodiment of a mandrel.
Figure 1E:
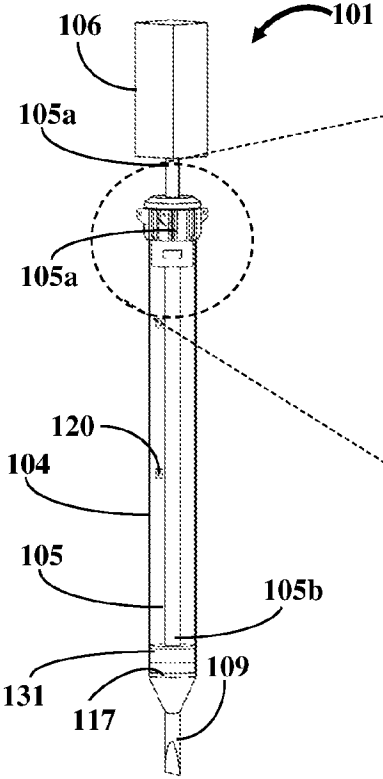
FIG. 1E exemplarily illustrates a perspective view of an embodiment of a mandrel.

FIGS. 1E-1F exemplarily illustrates a bore head 109 of the mandrel 101 configured in a wedge shape. In an embodiment, the drilling shaft 105 is configured in a wedge shape for boring through hard rocky layers of soil. A wedge steel ring 117 is positioned at the tip of the casing 104. The bore head 109 is positioned at the second end 105*b* of the drilling shaft 105 as exemplarily illustrated in FIGS. 1E-1F. Multiple connection elements 120 are provided for transferring the drilling shaft 105. Steel ring 129 and plates 128 are welded on a steel cylinder 119 positioned on the top of the casing 104 for transfer of dynamic force between the casing 104 and drilling shaft 105. In an embodiment, steel cylindrical rings 130 and 117 are positioned at the top and bottom of the drilling shaft 105 for transfer of dynamic force between the casing 104 and the drilling shaft 105. Vertical stiffener plates 122 are provided at the top of the casing 104. Steel plates 128 are welded on the drilling shaft 105 for connecting the drilling shaft 105 to the casing 104. A horizontal steel ring 130 increases stiffness of the casing 104 and creates the constraint between the vertical stiffener plates 122 and the casing 104. A generally cuboidal hammer element 106 extends from the drilling shaft 105 to transfer impact from an external vibratory hammer 107 to the casing 104 and drilling shaft 105 simultaneously as exemplarily illustrated in FIG. 8. In an embodiment, a steel cylinder 131 is provided for increasing the length of pyramid part and reduces the permission of fine sands during drive of the mandrel 101.

Figures 2A, 2B:
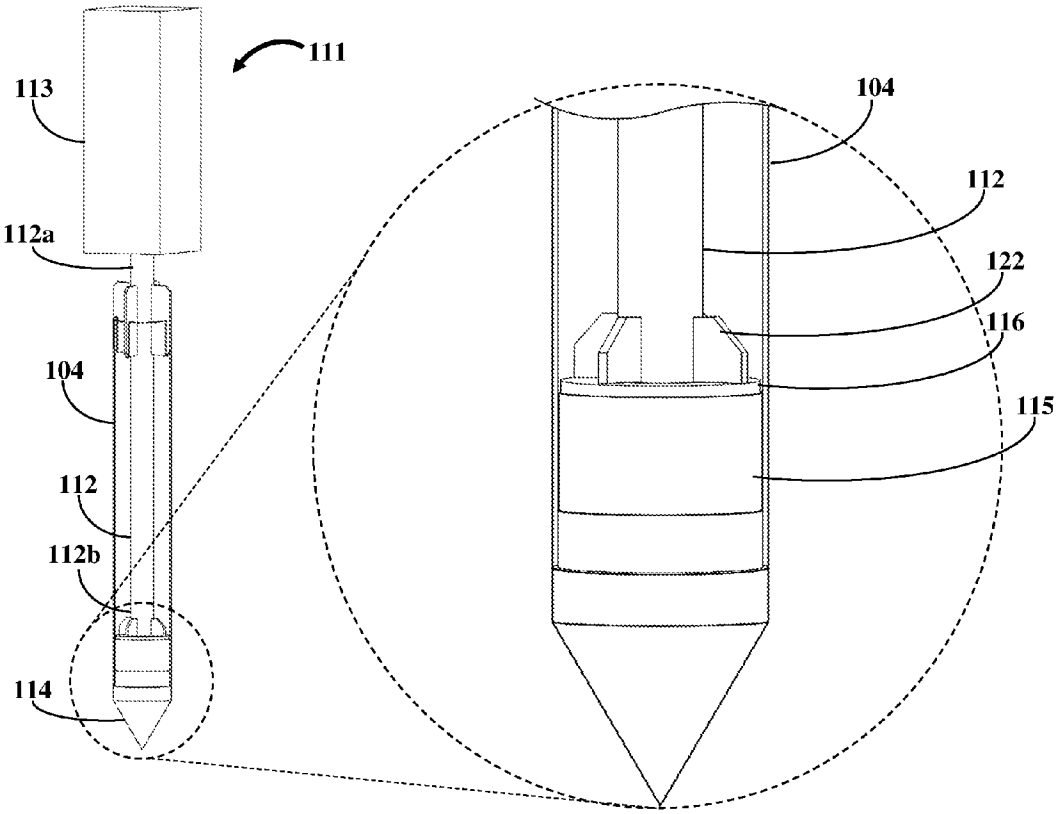
FIG. 2A exemplarily illustrates a perspective view of a tamper device.
FIG. 2B exemplarily illustrates an enlarged view of a section of a tamper device.

FIGS. 2A-2B exemplarily illustrates perspective views of different embodiments of a tamper device 111. In an embodiment, the tamper device 111 compacts the aggregate pier 102 formed at the target location 103 as exemplarily illustrated in FIGS. 4-7B. The tamper device 111 for compaction the filled aggregate comprises a compacting shaft 112. The compacting shaft 112 comprises a first end 112*a* and a second end 112*b*. A generally cuboidal second hammer element 113 extends from the first end 112*a* of the compacting shaft 112. The second hammer element 113 transfers the multiple impacts by shaft 112 to a compaction head 114 positioned at the second end 112*b* of the compacting shaft 112. The repeated impact forces transferred to the aggregates form a compacted aggregated pier 102 at the target location 103. In an embodiment, the compaction head 114 is configured in the shape of a pyramid segment at the second end 112*b* of the compacting shaft 112. In an embodiment, a plastic cylinder 115 is positioned between the casing 104 and the compacting shaft 112. A steel ring 116 is fixed above the plastic cylinder 115 to constrain the plastic cylinder 115. The steel ring 116 is fixed using four vertical stiffener plates 122 as exemplarily illustrated in FIGS. 2A-2B.

Figures 2C, 2D:
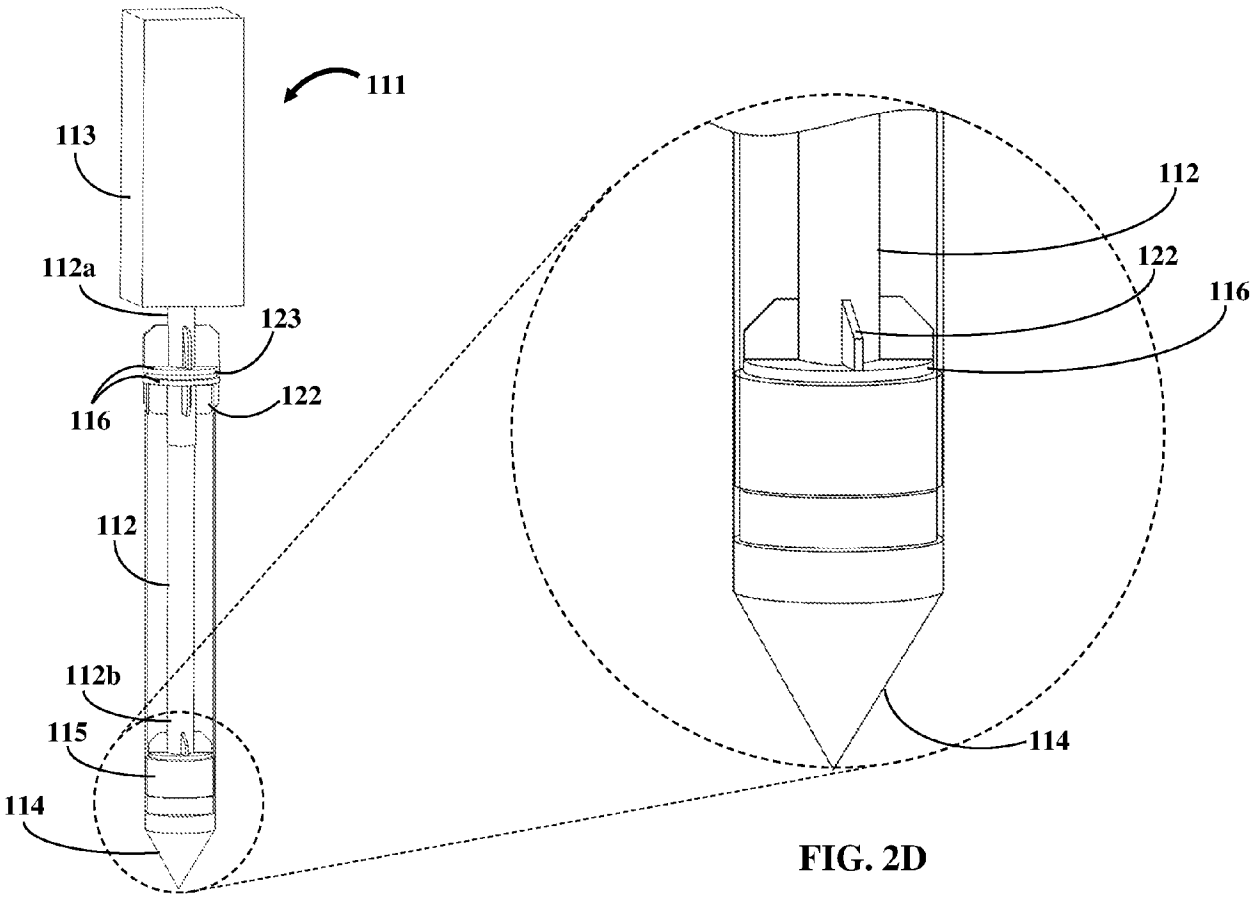
FIG. 2C exemplarily illustrates a perspective view of an embodiment of a tamper device.
FIG. 2D exemplarily illustrates an enlarged view of a section of an embodiment of a tamper device.

FIGS. 2C-2D exemplarily illustrates perspective views of different embodiments of a tamper device 111. The general structure and components of the tamper device 111 exemplarily illustrated in FIGS. 2C-2D are similar to the tamper device 111 illustrated in FIGS. 2A-2B except for a few differences described herein. The compaction head 114 is configured in a pyramidal shape and is fastened to the compacting shaft 112 at a second end 112*b* of the compacting shaft 112. In an embodiment, the compaction head 114 is made of a steel material. A plastic cylinder 115 is positioned between the casing 104 and the compacting shaft 112. A fixed steel ring 116 is provided to constrain movement of the plastic cylinder 115. Four vertical stiffener plates 122 are provided for fixing of the steel ring plate 116 above the plastic cylinder 115. In an embodiment, four or six vertical stiffener plates 122 are provided on top of the compacting shaft 112. A steel ring 116 is provided on the top of the casing 104. An elastic damper 123 is positioned between the steel rings 116.

Figure 3B:
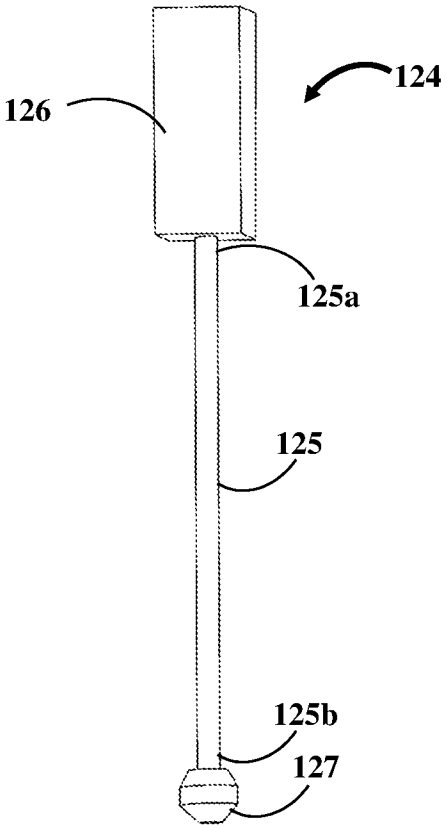
FIG. 3B exemplarily illustrates a perspective view of an embodiment of a finishing tamper device.
Figure 3A:
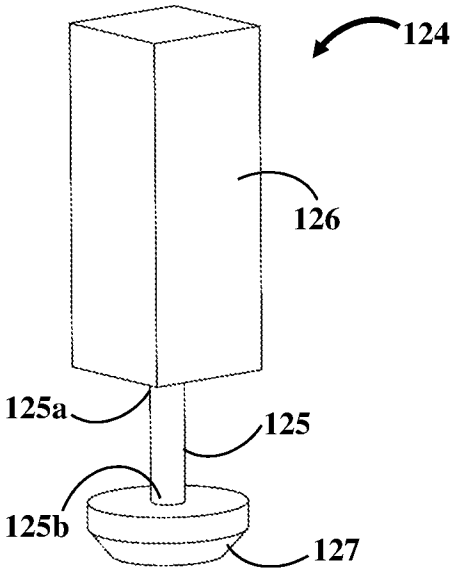
FIG. 3A exemplarily illustrates a perspective view of a finishing tamper device.

FIGS. 3A-3B exemplarily illustrates perspective views of different embodiments of a finishing tamper device 124. The finishing tamper device 124 comprises a shaft 125. In an embodiment, the shaft 125 comprises a first end 125*a* and a second end 125*b*. A generally cuboidal third hammer element 126 extends from the first end 125*a* of the shaft 125 for receiving multiple impacts from the external vibratory hammer 107 exemplarily illustrated in FIG. 8. The shaft 125 transfers the impact to a finishing head 127 positioned at the second end 125*b* of the shaft 125 for compacting a top layer of the compacted aggregate pier 102 to form a finished aggregate pier 102. In an embodiment, the finishing head 127 is configured as a flat beveled tamper as exemplarily illustrated in FIG. 3A. In another embodiment, the finishing head 127 is configured as a cylindrical double beveled tamper as exemplarily illustrated in FIG. 3B.

One aspect of the present disclosure is a mandrel for forming an aggregate pier at a target location. The mandrel comprises a casing having a generally hollow cylindrical configuration for housing a drilling shaft. The drilling shaft comprises a first end and a second end, a generally cuboidal hammer element extending from the first end of the drilling shaft for receiving multiple impacts from an external vibratory hammer. The first end detachably can be attached to the casing via a locking pin for transferring the impact to a bore head positioned at the second end of the drilling shaft for forming a cavity at the target location. The drilling shaft can be detached from the casing to fill the casing with aggregate, and the aggregate filled casing forms the aggregate pier at the target location.

One aspect of the present disclosure is directed to a method for forming a compacted aggregate pier at a target location. The method comprises providing an aggregate pier compacting system comprising: a mandrel comprising: a casing having a generally hollow cylindrical configuration; and a drilling shaft comprising a first end and a second end, a generally cuboidal hammer element extending from the first end of the drilling shaft, wherein the first end may be detachably attached to the casing via a locking pin, and wherein a bore head is positioned at the second end of the drilling shaft; a tamper device comprising a compacting shaft comprising a first end and a second end, a generally cuboidal second hammer element extending from the first end of the compacting shaft, wherein a compaction head is positioned at the second end of the compacting shaft; and a finishing tamper device comprising a shaft, the shaft comprising a first end and a second end, a generally cuboidal third hammer element extending from the first end of the shaft, wherein a finishing head is positioned at the second end of the shaft; positioning the mandrel above the target location; generating a cavity by driving the mandrel using an external vibratory hammer; removing the drilling shaft from the casing of the mandrel positioned in the cavity; filling the casing of the mandrel with aggregate at least once; removing the casing from the cavity filled with aggregate; compacting the aggregate filled cavity at least once using the tamper device; and compacting a top layer of the compacted aggregate pier with the finishing tamper device to form a finished aggregate pier at the target location.

Figure 4:
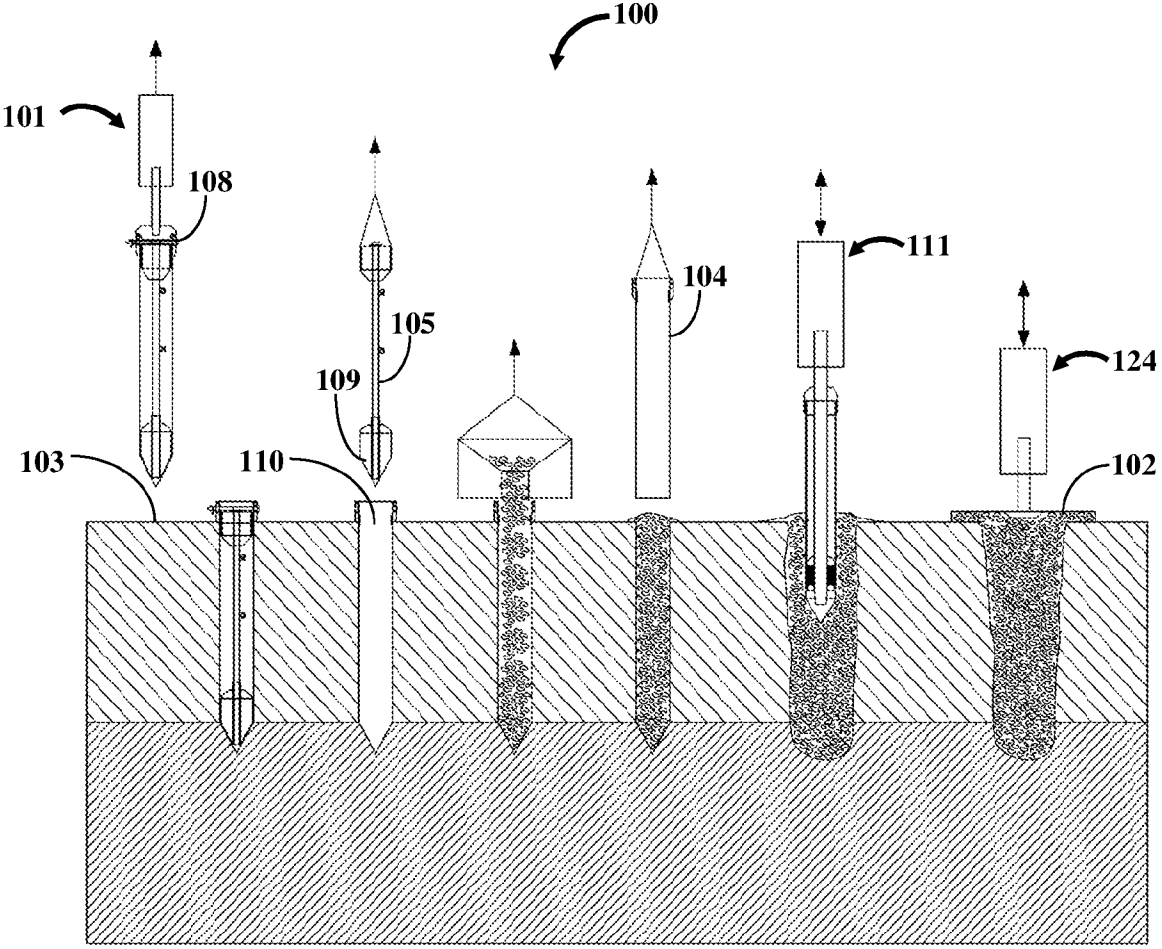
FIG. 4 exemplarily illustrates a method of construction of a compact aggregate pier in a loose and liquefied soil bed.

FIG. 4 exemplarily illustrates a method of construction of a compact aggregate pier 102 in a loose and liquefied soil bed. The aggregate pier compacting system 100 for forming a compacted aggregate pier 102 at a target location 103 comprises a mandrel 101, a tamper device 111, and a finishing tamper device 124 as exemplarily illustrated in FIGS. 1A-3B. The aggregate pier compacting system 100 is used to form a finished aggregate pier 102 exemplarily illustrated in FIG. 4. In an embodiment, the aggregate used is, for example, a gravel material. First, the mandrel 101 having appropriate diameter and length is positioned above the target location 103 where the compact aggregate piers 102 are going to be constructed. In an embodiment, the mandrel 101 is attached to an external vibratory hammer 107, for example, a hydraulic hammer placed on an excavator as exemplarily illustrated in FIG. 8. The external vibratory hammer 107 drives the mandrel 101 into the soil using intermittent blows. By applying the intermittent blows from the hydraulic hammer to the casing 104, the impact of the blows are transferred to the bore head 109 by means of a locking pin 108 between the casing 104 and the drilling shaft 105. By hammering the mandrel 101 into the loose granular soil, the soil surrounding the mandrel 101 is shaken and liquefies.

Therefore, relative density of the soil is increased. Due to creation of a cavity 110 in the ground, the surrounding soil of the mandrel 101 is compacted radially and the soil density is increased. Furthermore, due to creation of a cavity 110 in the ground, the materials are not removed from the cavity 110 and the site is cleaned. The mandrel 101 is driven to the required depth using an external vibratory hammer 107 installed on an excavator as exemplarily illustrated in FIG. 8. The locking pin 108 is unlocked on top of the casing 104 and the drilling shaft 105 is taken out. The aggregate is poured in the casing 104 using a hopper. The casing 104 is removed from the soil bed. The filled aggregate is compacted by driving a tamper device 111 repeatedly using the external vibratory hammer 107 installed on the excavator. Once the lower layers of the aggregate pier 102 are compacted, final hammering of the top layer of the aggregate pier 102 is done by the flat beveled finishing tamper device 124 hammered by the external vibratory hammer 107 installed on the excavator and preparing the ballast layer for implementation of the other layers of the embankment.

Figure 5A:
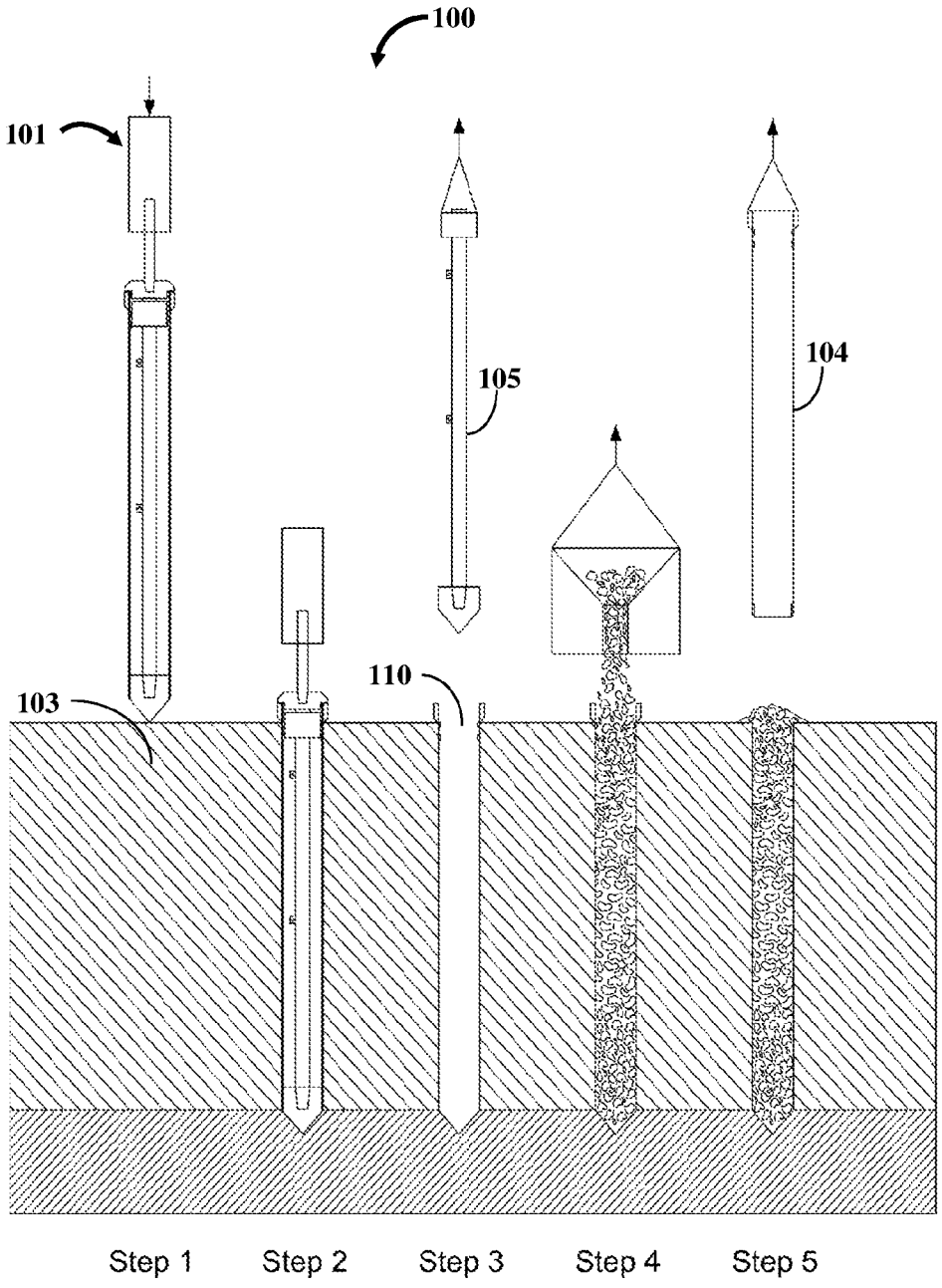
FIG. 5A exemplarily illustrates a method of construction of a compact aggregate pier in a soil bed having low to medium relative density.
Figure 5B:
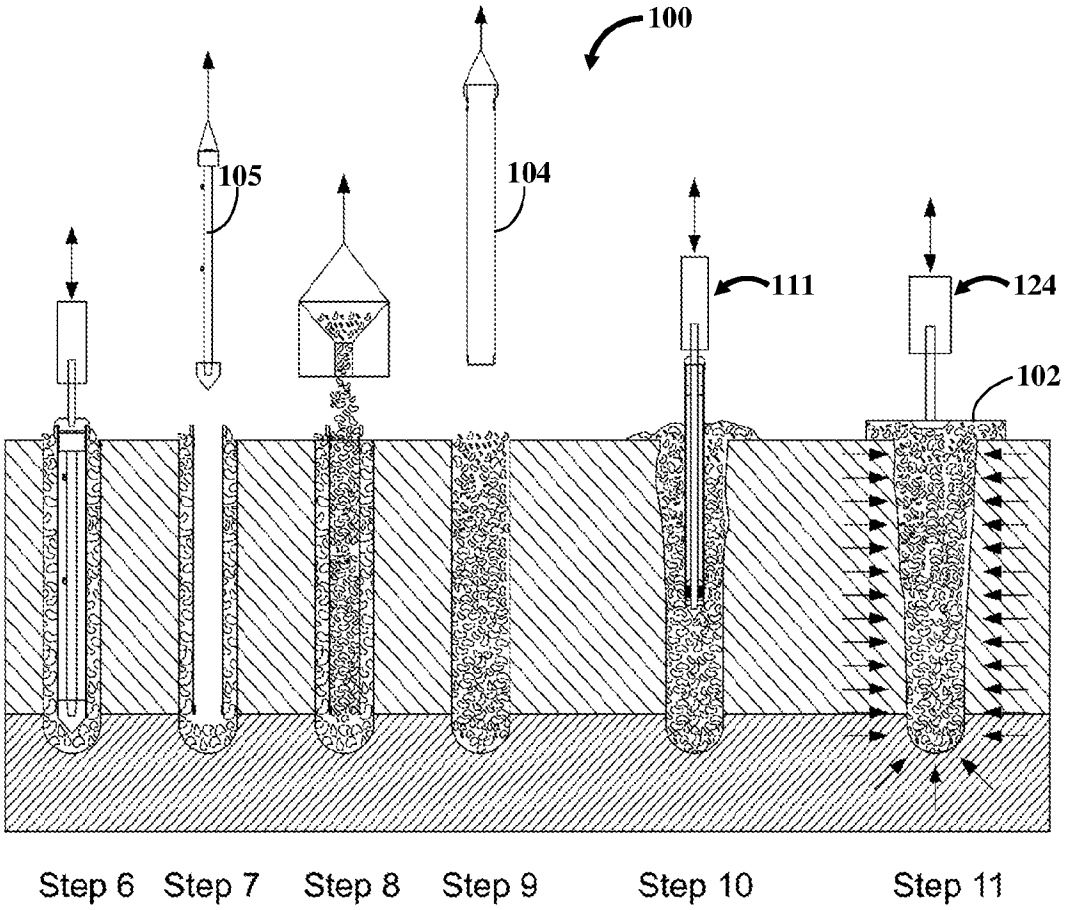
FIG. 5B exemplarily illustrates a method of construction of a compact aggregate pier in a soil bed having low to medium relative density.

FIGS. 5A-5B exemplarily illustrates a method of construction of a compact aggregate pier 102 in a soil bed having low to medium relative density. The aggregate pier compacting system 100 for forming a compacted aggregate pier 102 at a target location 103 comprises a mandrel 101, a tamper device 111, and a finishing tamper device 124 as exemplarily illustrated in FIGS. 1A-3B. The aggregate pier compacting system 100 is used to form a finished aggregate pier 102 exemplarily illustrated in FIGS. 5A-5B. In this method, the mandrel 101 is positioned above a target location 103. An external vibratory hammer 107, for example, a hydraulic hammer installed on an excavator, etc., hammers the mandrel 101 to the required depth as exemplarily illustrated in FIG. 8. The locking steel plates 128 and steel ring 129 used to fasten the drilling shaft 105 to the casing 104 of the mandrel 101 is released. The drilling shaft 105 is removed from the casing 104.

The aggregate material, for example, gravel is poured into the empty casing 104. The casing 104 is removed from the soil bed. The mandrel 101 is hammered again to the required depth into the aggregate filled pier 102 using the external vibratory hammer 107. The locking steel plates 128 of the casing 104 and of a steel cylinder 119 are released again to remove the drilling shaft 105. The aggregate material is poured into the casing 104. The casing 104 is removed from the soil bed. A tamper device 111 is inserted in to the aggregate material of the aggregate pier 102 and the external vibratory hammer 107 installed on the excavator repeatedly hammers the tamper device 111. The finishing tamper device 124 does a final hammering of the top layer of the aggregate pier 102. In an embodiment, the finishing tamper device 124 is a flat tamper hammered by the external vibratory hammer 107 installed on the excavator and preparing the ballast layer for implementation of the other layers of the embankment.

Figure 6A:
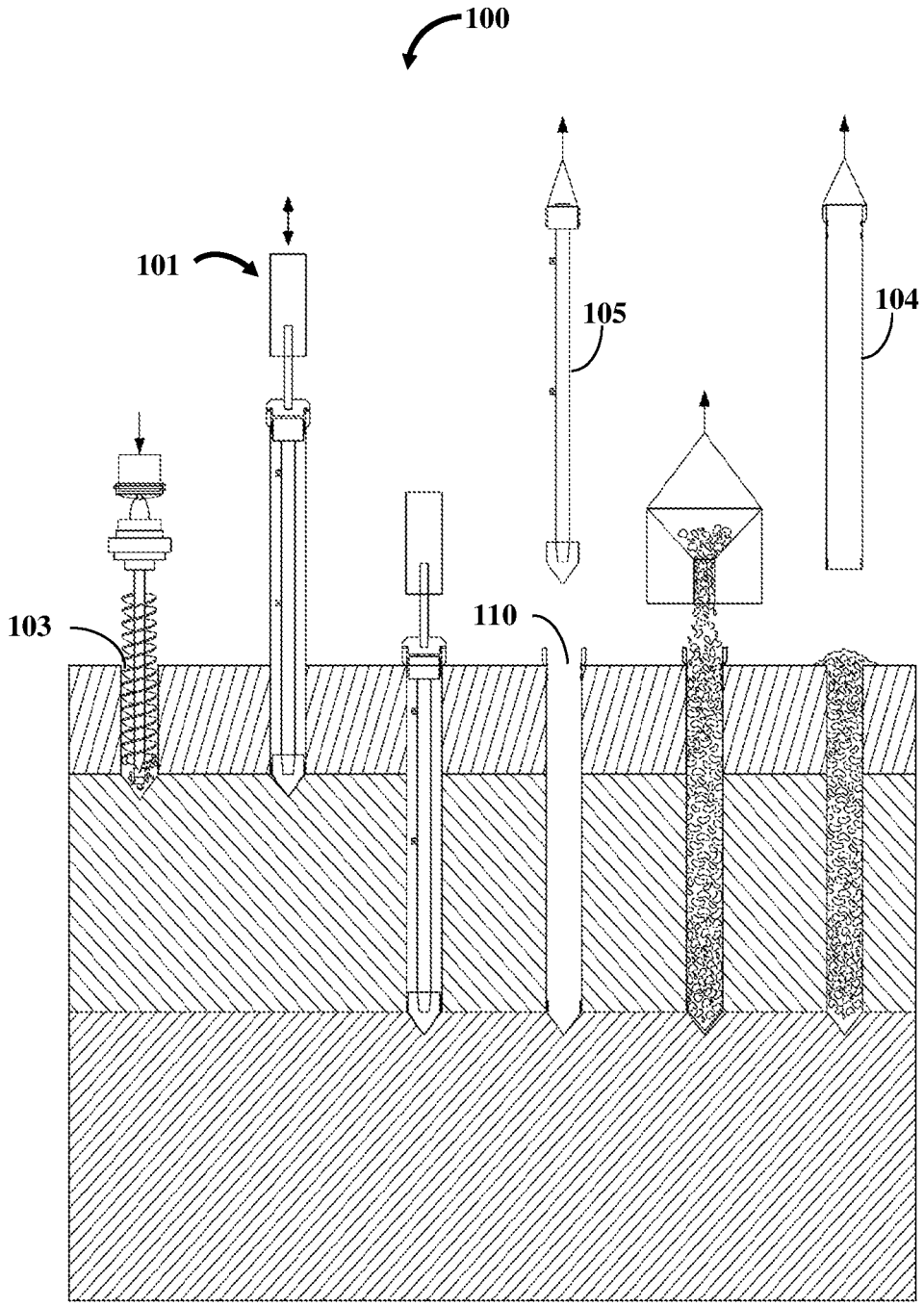
FIG. 6A exemplarily illustrates a method of construction of compacted aggregate pier in a two-layer soil bed having loose to medium relative density soil.
Figure 6B:
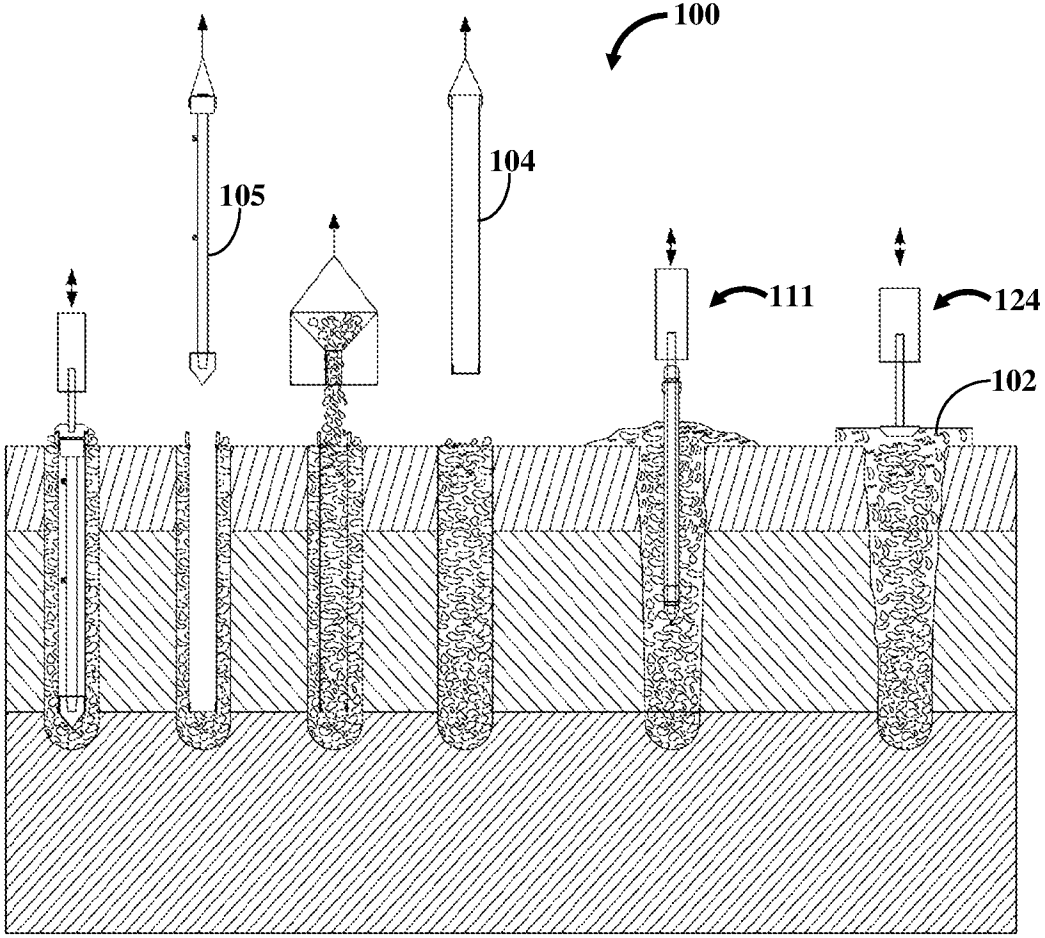
FIG. 6B exemplarily illustrates a method of construction of compacted aggregate pier in a two-layer soil bed having loose to medium relative density soil.

FIGS. 6A-6B exemplarily illustrates a method of construction of compacted aggregate pier 102 in a two-layer soil bed having loose to medium relative density soil. The aggregate pier compacting system 100 for forming a compacted aggregate pier 102 at a target location 103 comprises a mandrel 101, a tamper device 111, and a finishing tamper device 124 as exemplarily illustrated in FIGS. 1A-3B. The aggregate pier compacting system 100 is used to form a finished aggregate pier 102 exemplarily illustrated in FIGS. 6A-6B. A mechanical auger conducts first, a preliminary excavation of the target location 103 in the upper strong layer. The mandrel 101 is positioned above the target location 103. The mandrel 101 is hammered to the required depth by means of an external vibratory hammer 107 installed on an excavator in the soil bed. The locking steel plates 128 of the casing 104 and of a steel cylinder 119 are opened to release and remove the drilling shaft 105. The aggregate is then poured into the empty casing 104. The casing 104 is removed from the soil bed.

Figure 8:
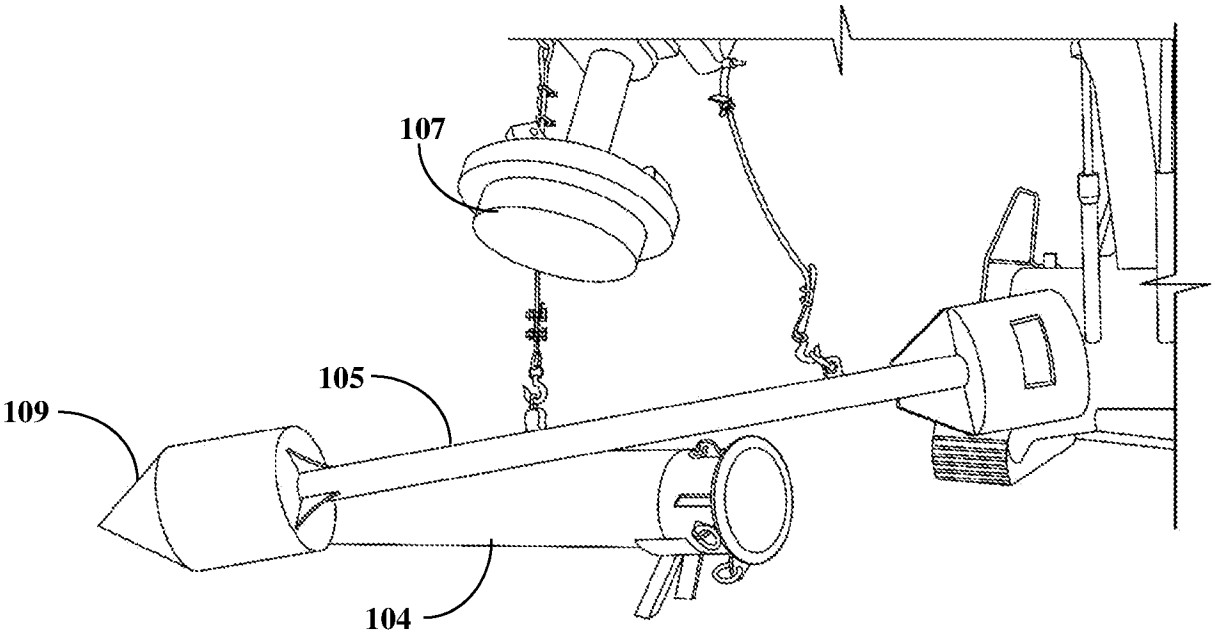
FIG. 8 exemplarily illustrates a perspective view of a mandrel.

The mandrel 101 is hammered again to the required depth into the aggregate pier 102 by means of an external vibratory hammer 107 installed on an excavator as exemplarily illustrated in FIG. 8. The locking steel plates 128 of the casing 104 and of a steel cylinder 119 is opened again to release and remove the drilling shaft 105 fastened to the casing 104. The aggregate is poured again into the casing 104. The casing 104 is finally removed from the soil bed. The external vibratory hammer 107 installed on the excavator hammers a tamper device 111 into the aggregate filled casing 104. A finishing tamper device 124 hammers the top layer of the aggregate pier 102 for finally preparing the ballast layer for implementation of the other layers of the embankment.

Figure 7A:
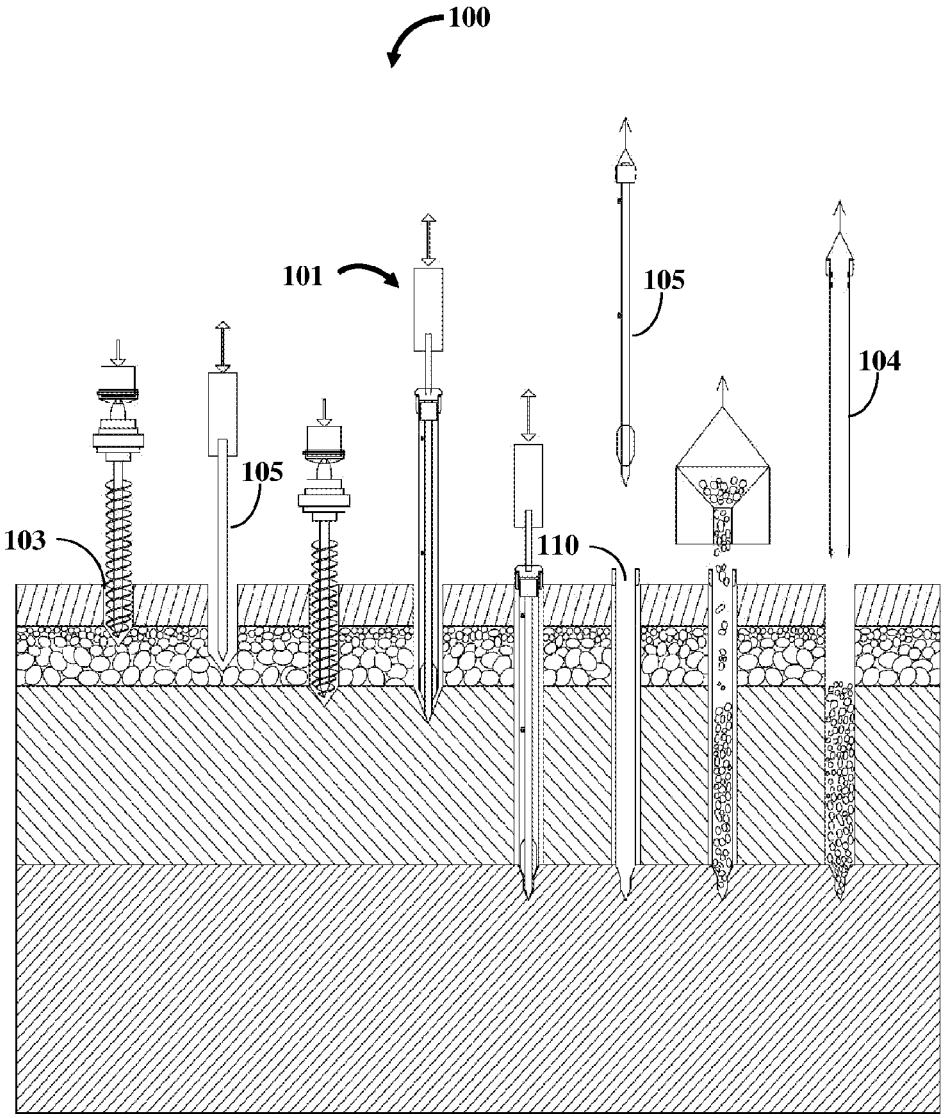
FIG. 7A exemplarily illustrates a method of construction of compacted aggregate pier in a three-layer soil bed consisting of a hard thin layer placed on a rock fill layer on top of a loose to medium relative density layer.
Figure 7B:
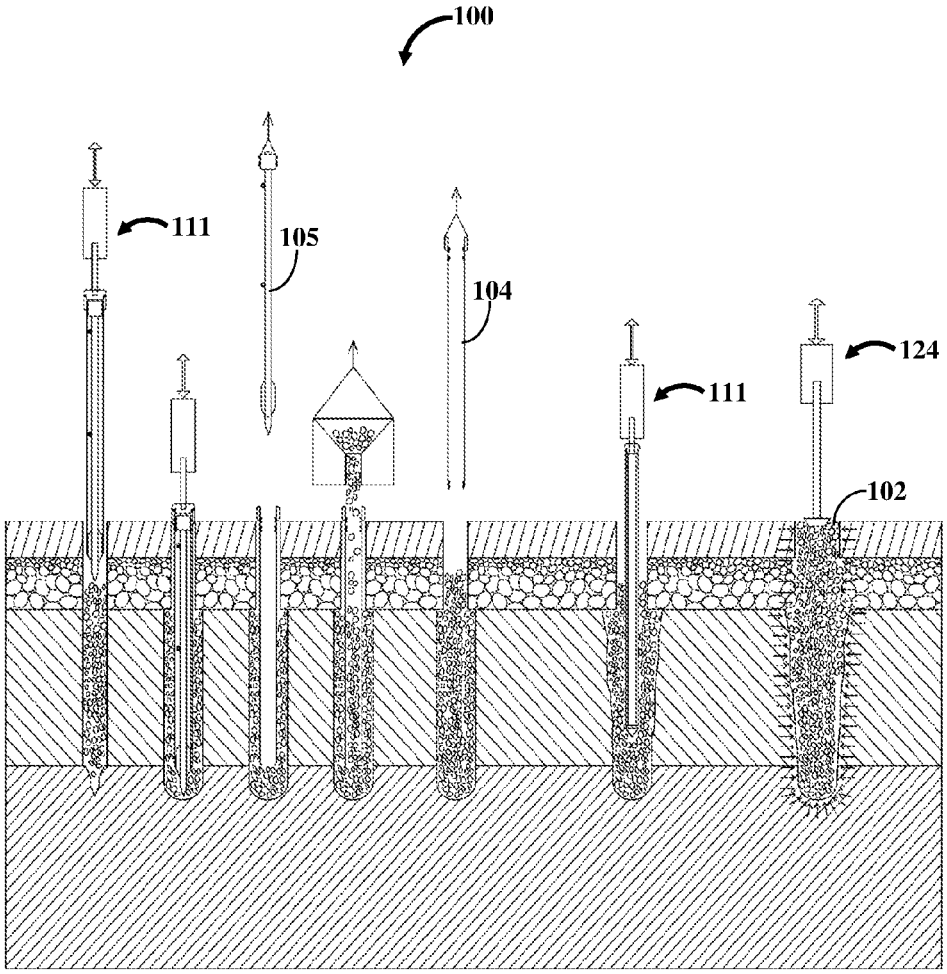
FIG. 7B exemplarily illustrates a method of construction of compacted aggregate pier in a three-layer soil bed consisting of a hard thin layer placed on a rock fill layer on top of a loose to medium relative density layer.

FIGS. 7A-7B exemplarily illustrate a method of construction of compacted aggregate pier 102 in a three-layer soil bed consisting of a hard thin layer placed on a rock fill layer on top of a loose to medium relative density layer. The aggregate pier compacting system 100 for forming a compacted aggregate pier 102 at a target location 103 comprises a mandrel 101, a tamper device 111, and a finishing tamper device 124 as exemplarily illustrated in FIGS. 1A-3B. The aggregate pier compacting system 100 is used to form a finished aggregate pier 102 exemplarily illustrated in FIGS. 7A-7B. A mechanical auger excavates the first hard layer of the soil bed. The rock fills of the second layer is crashed and excavated frequently by a mandrel with a bore head configured in a wedge shape 132 and a mechanical auger as exemplarily illustrated in FIG. 1E.

In one aspect, the present disclosure is directed to an aggregate pier compacting system for forming a compacted aggregate pier at a target location. This aggregate pier compacting system comprises a mandrel for forming an aggregate pier at the target location. The mandrel comprises a casing having a generally hollow cylindrical configuration for housing a drilling shaft. The drilling shaft comprises a first end and a second end, a generally cuboidal hammer element extending from the first end of the drilling shaft for receiving multiple impacts from an external vibratory hammer. The first end may be detachably attached to the casing via a locking system for transferring the impact to a bore head positioned at the second end of the drilling shaft for forming a cavity at the target location, wherein the drilling shaft is detached from the casing to fill the casing with aggregate, and the aggregate filled casing forms the aggregate pier at the target location. The mandrel further comprises a tamper device for compacting the filled aggregate comprising a compacting shaft comprising a first end and a second end, a generally cuboidal second hammer element extending from the first end of the compacting shaft for receiving multiple impacts from the external vibratory hammer and transferring the impacts to a compaction head positioned at the second end of the compacting shaft for forming the compacted aggregated pier at the target location. The mandrel further comprises a finishing tamper device comprising a shaft, the shaft comprising a first end and a second end, a generally cuboidal third hammer element extending from the first end of the shaft for receiving multiple impacts from the external vibratory hammer and transferring the impacts to a finishing head positioned at the second end of the shaft for compacting a top layer of the compacted aggregate pier to form a finished aggregate pier at the target location. In one example, the bore head may be of one of a conical configuration and a pyramidal configuration. The bore head may be configured in a wedge shape to bore through hard rock surfaces. The compaction head may be of one of a conical configuration and a pyramidal configuration. The finishing head may be of one of a flat bevel configuration and a cylindrical double bevel configuration. The target location may be selected from a group consisting of a loose sandy soil, a clayey soil, a medium density soil, and a hard rock soil bed.

The mandrel 101 is hammered using the external vibratory hammer 107 installed on an excavator. The mandrel 101 having a wedge shape bore head 109 is hammered into the lower loose soil by the external vibratory hammer 107 installed on an excavator. The locking steel plates 128 of the casing 104 and of a steel cylinder 119 are opened and the drilling shaft 105 is removed. The aggregate material is poured into the casing 104 up to about 0.5 meter above the bottom elevation of the rock fill layer. The casing 104 is then removed from the soil bed. The mandrel 101 having a cylindrical or pyramidal bore head 109 is positioned above the target location 103. The mandrel 101 is hammered to the required depth into the aggregate pier 102 using the external vibratory hammer 107 installed on an excavator.

The locking steel plates 128 of the casing 104 and of a steel cylinder 119 are opened once again and the drilling shaft 105 is removed from the casing 104. The aggregate material is poured again into the casing 104 up to about 0.5 m above the bottom elevation of the rock fill layer. The casing 104 is removed from the partially compacted aggregate pier 102. The external vibratory hammer 107 installed on an excavator hammers a tamper device 111 positioned above the aggregate pier 102 repeatedly to compact the aggregate pier 102. A finishing tamper device 124 hammers the top layer of the aggregate pier 102 for finally preparing the ballast layer for implementation of the other layers of the embankment.

FIG. 8 exemplarily illustrates a perspective view of a mandrel 101. The drilling shaft 105 is removed from the casing 104 of the mandrel 101 as exemplarily illustrated in FIG. 8. In an embodiment, an external vibratory hammer 107 installed on an excavator drives the mandrel 101 into the target location 103, for example, loose soil, medium density soil, etc., with repeated blows on the mandrel 101. In an embodiment, the surface of the external vibratory hammer 107 is flat as exemplarily illustrated in FIG. 8.

Figure 9:
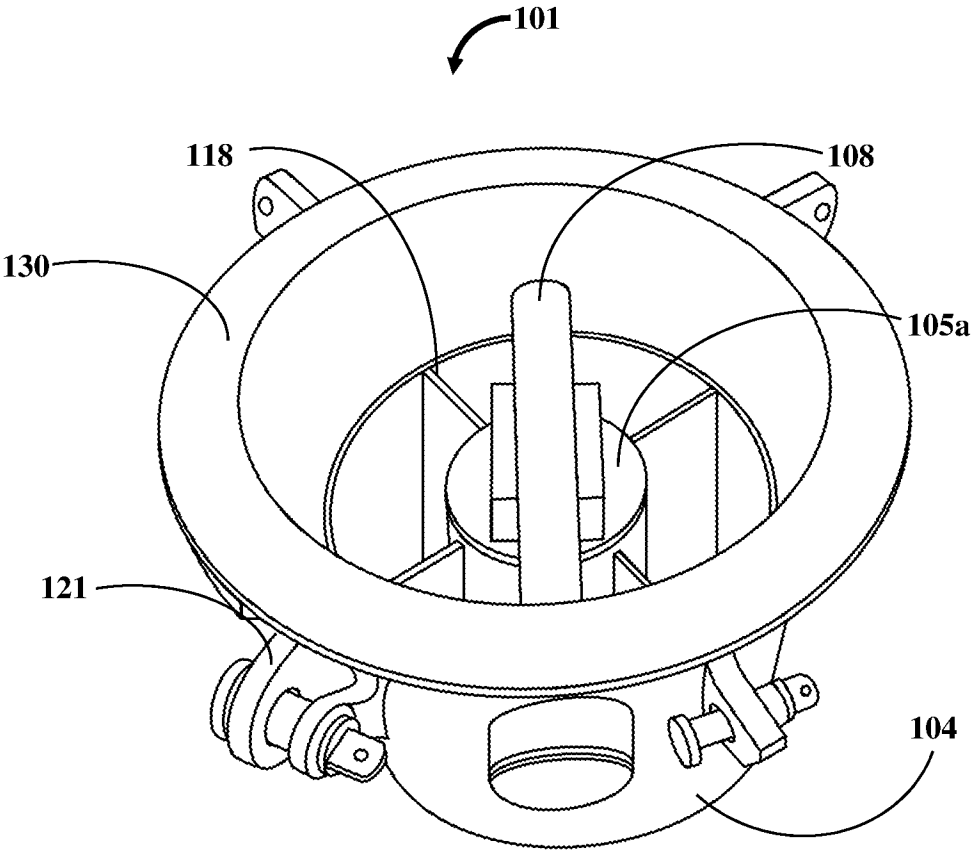
FIG. 9 exemplarily illustrates a top perspective view of a casing of a mandrel.

FIG. 9 exemplarily illustrates a top perspective view of a casing 104 of a mandrel 101. In an embodiment, the locking pin 108 attaches the drilling shaft 105 to the casing 104 and prevents the rotation of the drilling shaft 105 within the mandrel 101 when hammered by the external vibratory hammer 107 exemplarily illustrated in FIG. 8. The drilling shaft 105 is twisted into the casing 104 by means of a specific tool, for example, a pipe wrench, using two workers. Similarly, four steel plates 118 are provided at the top of the casing 104 for connection of a steel cylinder 119 to the drilling shaft 105 as exemplarily illustrated in FIGS. 1A-1B. A horizontal steel ring 130 is provided at the top of the casing 104 for increasing stiffness edge of the casing 104. In an embodiment, Steel plates 121 are welded on the steel cylinder 119 positioned on the top of the casing 104 for transfer of dynamic force between the casing 104 and drilling shaft 105. The first end 105*a* of the drilling shaft 105 is detachably attached to the casing 104 for transferring the impact to a bore head 109 as exemplarily illustrated in FIGS. 1A-1F.

Figure 10:
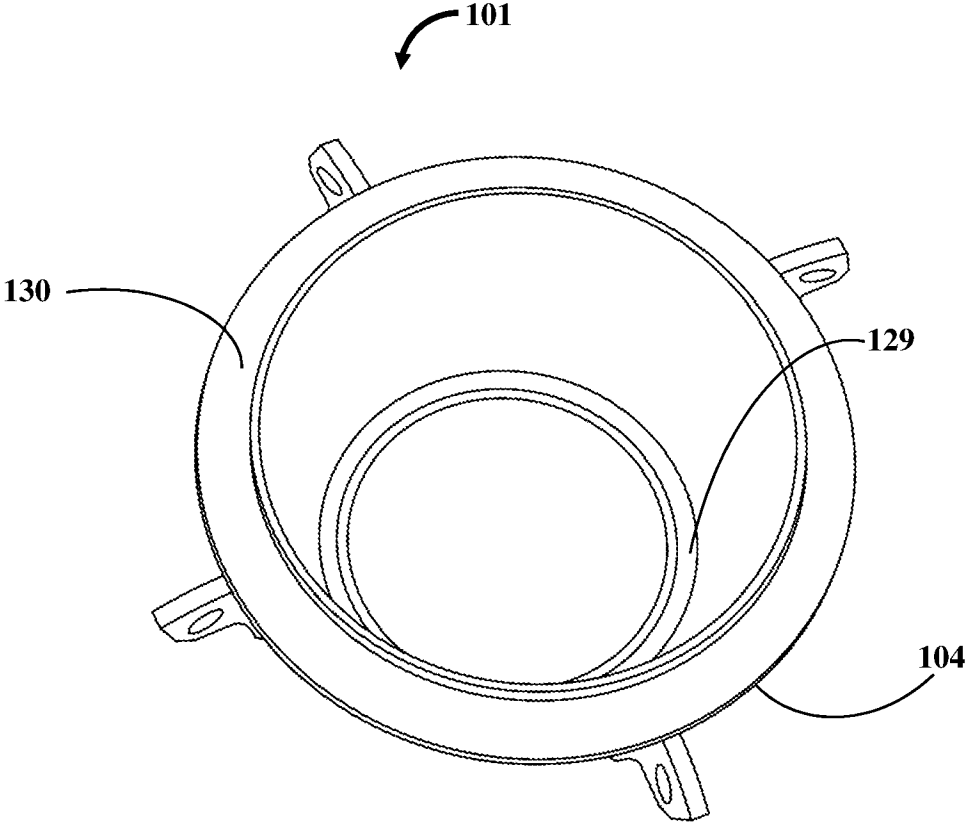
FIG. 10 exemplarily illustrates a top perspective view of a mandrel after hammering the mandrel into the soil bed and removing the drilling shaft.

FIG. 10 exemplarily illustrates a top view of a mandrel 101 after hammering the mandrel 101 into the soil bed and removing the drilling shaft 105. In an embodiment, the casing 104 ensures effective transfer of impact forces from the external vibratory hammer 107 to the bore head 109. A steel ring 129 is welded on the casing 104 for containing of the drilling shaft 105 during the lifting of the mandrel 101. Steel plates welded on the casing 104 ensure transfer of dynamic force between the casing 104 and the drilling shaft 105. In an embodiment, a steel ring 129 is welded on the casing 104 for containing of the drilling shaft 105 during the lifting of the mandrel 101. A horizontal steel ring 130 is provided at the top of the casing 104 for increasing stiffness edge of the casing 104.

Figure 11:
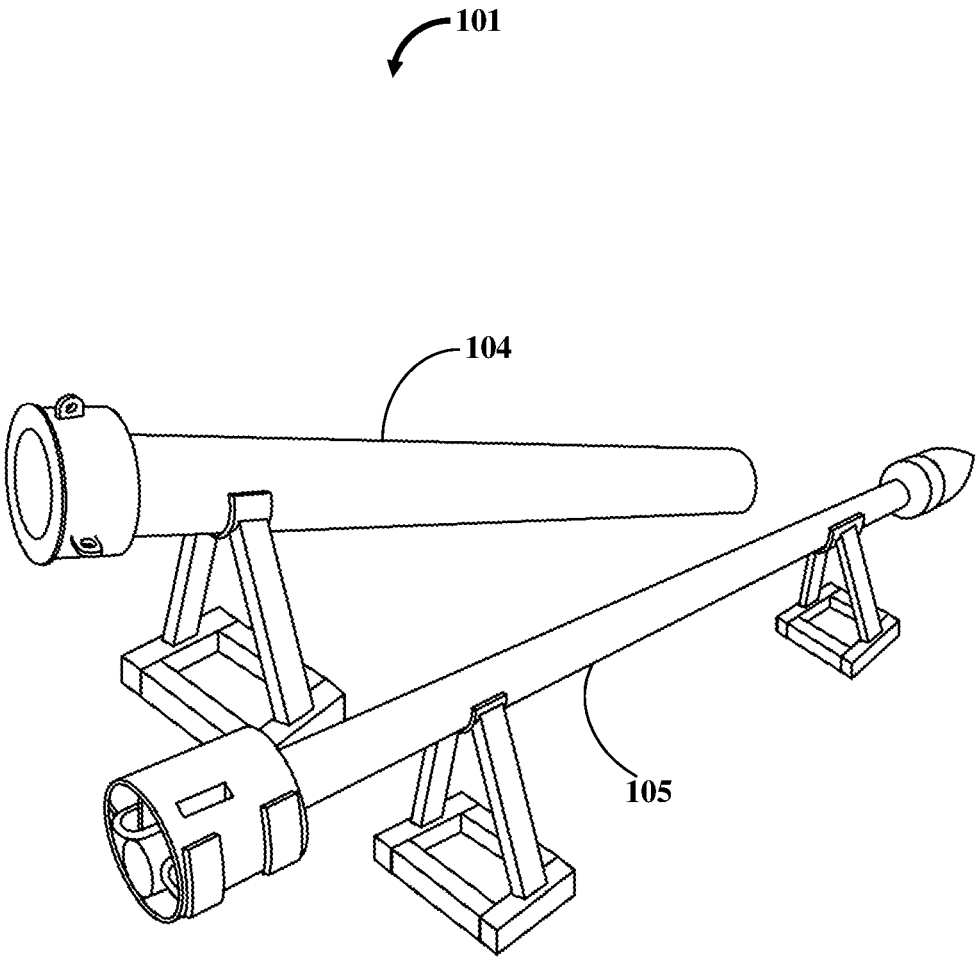
FIG. 11 exemplarily illustrates a casing and a drilling shaft of a mandrel.

FIG. 11 exemplarily illustrates a casing 104 and a drilling shaft 105 of a mandrel 101. After using the mandrel 101 to generate the cavity 110 at the target location 103, the locking steel plates 128 of the casing 104 and of a steel cylinder 119 of the mandrel 101 is unlocked and the drilling shaft 105 is removed. After use of both the casing 104 and the drilling shaft 105, they are positioned on mobile supports as exemplarily illustrated in FIG. 11. When the mandrel 101 is required, the casing 104 and the drilling shaft 105 are removed from the mobile supports and deployed.

Figure 12:
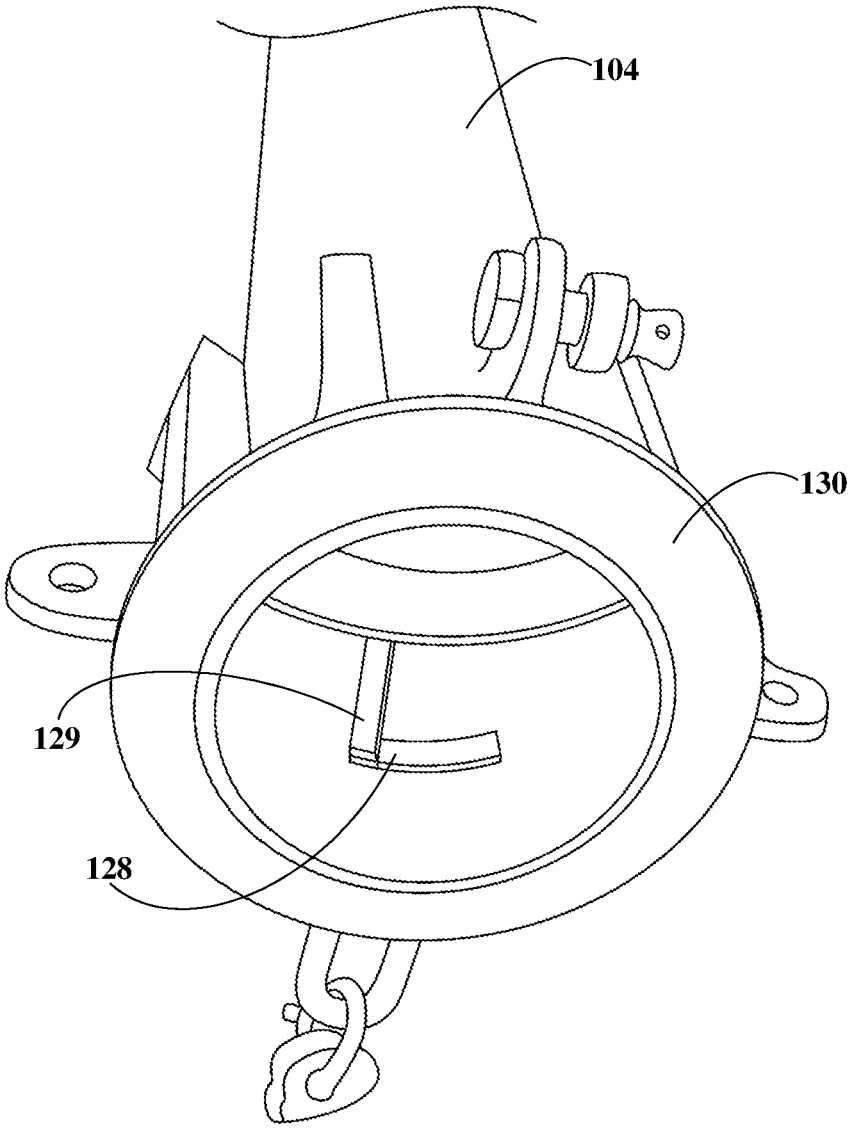
FIG. 12 exemplarily illustrates a top perspective view of a casing of a mandrel.

FIG. 12 exemplarily illustrates a top view of a casing 104 of a mandrel 101. Steel ring 130 and two plates 128 are welded on the steel cylindrical casing 104 for transfer of dynamic force between the casing 104 and the drilling shaft 105. Multiple connection elements 120 are provided for transferring the drilling shaft 105. Four vertical stiffener plates 122 are provided at the top of the casing 104. The edge of the casing 104 enables effective transfer of impact forces from the external vibratory hammer 107 to the casing 104. In an embodiment, a steel ring 129 is welded on the casing 104 for containing of the drilling shaft 105 during the lifting of the mandrel 101. A horizontal steel ring 130 is provided at the top of the casing 104 for increasing stiffness edge of the casing 104.

Figure 13:
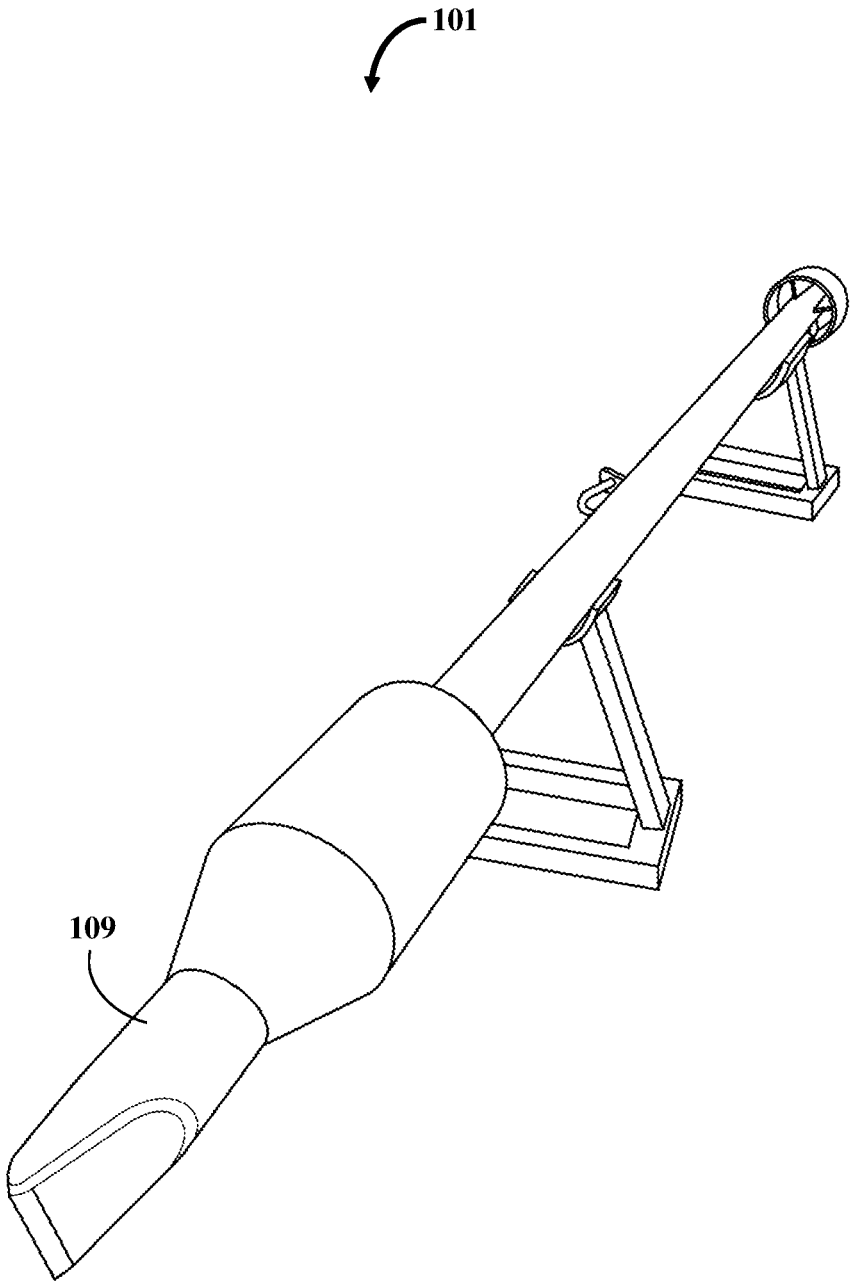
FIG. 13 exemplarily illustrates a front perspective view of a mandrel.

FIG. 13 exemplarily illustrates a front perspective view of a mandrel 101. In an embodiment, the bore head 109 of the mandrel 101 is configured in a wedge shape. The wedge shaped bore head 109 enables the mandrel to bore through rocky layers of the soil. In an embodiment, the bore head 109 is made of a high strength steel material.

Figure 14:
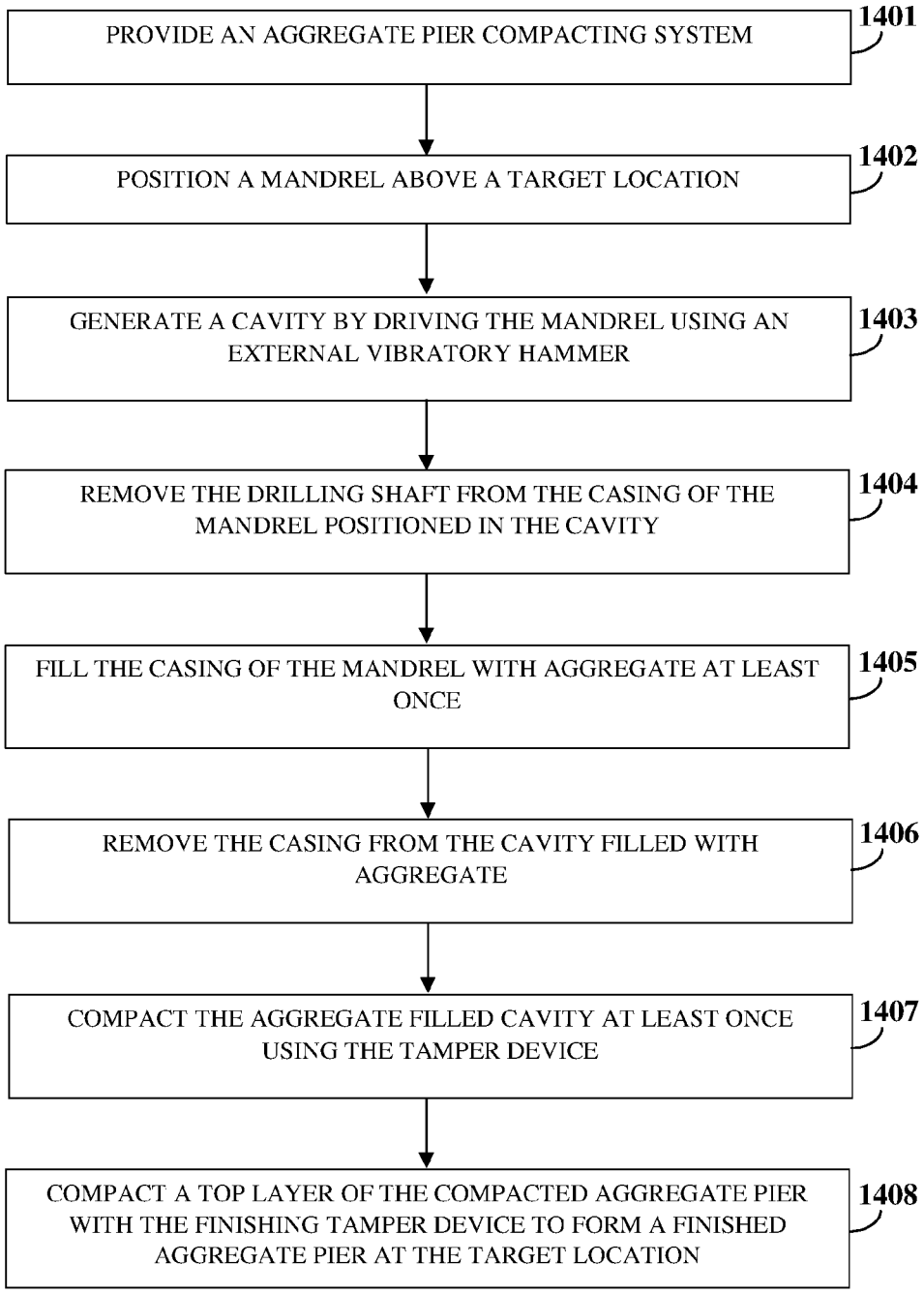
FIG. 14 exemplarily illustrates a method for forming a compacted aggregate pier at a target location.

FIG. 14 exemplarily illustrates a method for forming a compacted aggregate pier 102 at a target location 103. In the method disclosed herein, an aggregate pier compacting system 100 comprising a mandrel 101, a tamper device 111, and a finishing tamper device 124, is provided 1401. The mandrel 101 is positioned 1402 above the target location 103. A cavity 110 is generated 1403 by driving the mandrel 101 using an external vibratory hammer 107. The drilling shaft 105 is removed 1404 from the casing 104 of the mandrel 101 positioned in the cavity 110. The casing 104 of the mandrel 101 is filled 1405 with aggregate at least once. The casing 104 is then removed 1406 from the cavity 110 filled with aggregate. The aggregate filled cavity is compacted 1407 at least once using the tamper device 111. A top layer of the compacted aggregate pier is compacted 1408 again with the finishing tamper device 124 to form a finished aggregate pier 102 at the target location 103.

The aggregate pier may be compacted by a tamper device comprising a compacting shaft. The compacting shaft comprises a first end and a second end, a generally cuboidal second hammer element extending from the first end of the compacting shaft for receiving multiple impacts from the external vibratory hammer and transferring the impact to a compaction head positioned at the second end of the compacting shaft for forming the compacted aggregated pier at the target location.

A top layer of the compacted aggregate pier may be finely compacted by a finishing tamper device, comprising a shaft. The shaft comprises a first end and a second end, a generally cuboidal third hammer element extending from the first end of the shaft for receiving multiple impacts from the external vibratory hammer and transferring the impact to a finishing head positioned at the second end of the shaft for compacting the top layer of the compacted aggregate pier to form a finished aggregate pier at the target location. In one example, the aggregate is a gravel material. The bore head may be of one of a conical configuration and a pyramidal configuration. The bore head may be configured in a wedge shape to bore through hard rock surfaces. The target location may be selected from a group consisting of a loose sandy soil, a clayey soil, a medium density soil, and a hard rock soil bed.

The foregoing description comprises illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

What is claimed is:

1. A mandrel for forming a cavity at a target location, the mandrel comprising:

a casing having a hollow cylindrical configuration for housing a drilling shaft;

the drilling shaft comprising a first end and a second end, a cuboidal hammer element extending from the first end of the drilling shaft for receiving multiple impacts, wherein the first end of the drilling shaft is detachably attached to the casing via a locking system; and a bore head positioned at the second end of the drilling shaft for transferring the multiple impacts received by the drilling shaft to form the cavity at the target location;

four steel stiffener plates connecting the first end of the drilling shaft to a steel cylinder attached to the bore head, four additional steel plates connecting the second end of the drilling shaft to a second steel cylinder at the top of the casing and two connection elements provided on the drilling shaft, all for transferring a dynamic force between the casing and the drilling shaft; and a locking pin to prevent the drilling shaft from rotating inside the casing during hammering.

2. The mandrel of claim 1, wherein the bore head is of one of a conical configuration and a pyramidal configuration.

3. The mandrel of claim 1, wherein the bore head is configured in a wedge shape to bore through hard rock surfaces.

4. The mandrel of claim 1, wherein the target location is selected from a group consisting of a loose sandy soil, a clayey soil, a medium density soil, and a hard rock soil bed.

5. An aggregate pier compacting system for forming a compacted aggregate pier at a target location, the aggregate pier compacting system comprising:

(a) a mandrel comprising:

a casing having a hollow cylindrical configuration for housing a drilling shaft;

the drilling shaft comprising a first end and a second end, a cuboidal hammer element extending from the first end of the drilling shaft for receiving multiple impacts, wherein the first end of the drilling shaft is detachably attached to the casing via a locking system; and a bore head positioned at the second end of the drilling shaft for transferring the multiple impacts received by the drilling shaft to form a cavity at the target location;

four steel stiffener plates connecting the first end of the drilling shaft to a steel cylinder attached to the bore head, four additional steel plates connecting the second end of the drilling shaft to a second steel cylinder at the top of the casing and two connection elements provided on the drilling shaft, all for transferring a dynamic force between the casing and the drilling shaft; and a locking pin to prevent the drilling shaft from rotating inside the casing during hammering (b) a hopper comprising aggregate, wherein the hopper is configured to fill the cavity at the target location with aggregate;

(c) a tamper device comprising a compacting shaft comprising a first end and a second end, a cuboidal second hammer element extending from the first end of the compacting shaft for receiving multiple impacts and transferring the impact to a compaction head positioned at the second end of the compacting shaft; and (d) a finishing tamper device comprising a shaft, the shaft comprising a first end and a second end, a cuboidal third hammer element extending from the first end of the shaft for receiving multiple impacts and transferring the impact to a finishing head positioned at the second end of the shaft.

6. The aggregate pier compacting system of claim 5, wherein the bore head is of one of a conical configuration and a pyramidal configuration.

7. The aggregate pier compacting system of claim 5, wherein the bore head is configured in a wedge shape to bore through hard rock surfaces.

8. The aggregate pier compacting system of claim 5, wherein the compaction head is of one of a conical configuration and a pyramidal configuration.

9. The aggregate pier compacting system of claim 5, wherein the finishing head is of one of a flat bevel configuration and a cylindrical double bevel configuration.

10. The aggregate pier compacting system of claim 5, wherein the target location is selected from a group consisting of a loose sandy soil, a clayey soil, a medium density soil, and a hard rock soil bed.

11. A method for forming a compacted aggregate pier at a target location, the method comprising:

(a) providing an aggregate pier compacting system comprising:

a mandrel comprising:

a casing having a hollow cylindrical configuration; and a drilling shaft comprising a first end and a second end, a cuboidal hammer element extending from the first end of the drilling shaft, wherein the first end is detachably attached to the casing via a locking system, and wherein a bore head is positioned at the second end of the drilling shaft;

four steel stiffener plates connecting the first end of the drilling shaft to a steel cylinder attached to the bore head, four additional steel plates connecting the second end of the drilling shaft to a second steel cylinder at the top of the casing and two connection elements provided on the drilling shaft, all for transferring a dynamic force between the casing and the drilling shaft; and a locking pin to prevent the drilling shaft from rotating inside the casing during hammering a tamper device comprising a compacting shaft comprising a first end and a second end, a cuboidal second hammer element extending from the first end of the compacting shaft, wherein a compaction head is positioned at the second end of the compacting shaft; and a finishing tamper device comprising a shaft, the shaft comprising a first end and a second end, a cuboidal third hammer element extending from the first end of the shaft, wherein a finishing head is positioned at the second end of the shaft;

(b) positioning the mandrel above the target location;

(c) generating a cavity by driving the mandrel using an external vibratory hammer;

(d) removing the drilling shaft from the casing of the mandrel positioned in the cavity;

(e) filling the casing of the mandrel with aggregate at least once;

(f) removing the casing from the cavity filled with aggregate;

(g) compacting the aggregate filled cavity at least once using the tamper device; and (h) compacting a top layer of the compacted aggregate pier with the finishing tamper device to form a finished aggregate pier at the target location.

12. The method of claim 11, wherein the aggregate is a gravel material.

13. The method of claim 11, wherein the bore head is of one of a conical configuration and a pyramidal configuration.

14. The method of claim 11, wherein the bore head is configured in a wedge shape to bore through hard rock surfaces.

15. The method of claim 11, wherein the compaction head is of one of a conical configuration and a pyramidal configuration.

16. The method of claim 11, wherein the finishing head is of one of a flat bevel configuration and a cylindrical double bevel configuration.

17. The method of claim 11, wherein the target location is selected from a group consisting of a loose sandy soil, a clayey soil, a medium density soil, and a hard rock soil bed.

* * * * *